United States Patent [19]

Inoue

[11] Patent Number: 4,966,833

[45] Date of Patent: Oct. 30, 1990

[54] METHOD FOR THE FORMATION OF DIRECT POSITIVE COLOR IMAGES

[75] Inventor: Noriyuki Inoue, Kanagawa, Japan

[73] Assignee: Fuji Photo Film Co., Ltd., Kanagawa, Japan

[21] Appl. No.: 253,471

[22] Filed: Oct. 5, 1988

[30] Foreign Application Priority Data

Oct. 5, 1987 [JP] Japan ..... 62-251379

[51] Int. Cl.[5] ..... G03C 5/24; G03C 7/00; G03C 1/485

[52] U.S. Cl. ..... 430/378; 430/406; 430/407; 430/410; 430/445; 430/446; 430/547; 430/611

[58] Field of Search ..... 430/378, 406, 409, 460, 430/445, 446, 547, 611

[56] References Cited

U.S. PATENT DOCUMENTS

| | | | |
|---|---|---|---|
| 4,094,683 | 6/1978 | Tsujino et al. | 96/95 |
| 4,115,122 | 9/1978 | Adachi et al. | 96/76 |
| 4,245,037 | 1/1981 | Tsujino et al. | 430/559 |
| 4,255,511 | 3/1981 | Hirano et al. | 430/217 |
| 4,264,721 | 5/1981 | Shimano et al. | 430/611 |
| 4,294,919 | 10/1981 | Tsujino et al. | 430/559 |
| 4,324,855 | 4/1982 | Uishi et al. | 430/378 |
| 4,358,528 | 11/1982 | Takagi et al. | 430/281 |
| 4,374,923 | 2/1983 | Hirano et al. | 430/410 |
| 4,395,478 | 7/1983 | Hoyen | 430/547 |
| 4,444,871 | 4/1984 | Miyaoka et al. | 430/378 |
| 4,451,561 | 5/1984 | Hirabayashi et al. | 430/611 |
| 4,471,044 | 9/1984 | Parton et al. | 430/217 |
| 4,481,285 | 11/1984 | Takagi et al. | 430/410 |
| 4,526,861 | 7/1985 | Ichitima et al. | 430/385 |
| 4,540,655 | 9/1985 | Takagi et al. | 430/410 |
| 4,590,155 | 5/1986 | Klotzer | 430/376 |
| 4,636,457 | 1/1987 | Valbusa et al. | 430/375 |
| 4,738,917 | 4/1988 | Koboshi et al. | 430/377 |
| 4,789,627 | 12/1988 | Inoue et al. | 430/406 |
| 4,801,520 | 1/1985 | Inoue et al. | 430/378 |

FOREIGN PATENT DOCUMENTS

| | | |
|---|---|---|
| 3313394 | 10/1983 | Fed. Rep. of Germany . |
| 3313763 | 10/1983 | Fed. Rep. of Germany . |
| 151635 | 11/1980 | Japan . |
| 178345 | 10/1983 | Japan . |
| 181040 | 10/1983 | Japan . |
| 134513 | 6/1986 | Japan . |
| 136949 | 6/1986 | Japan . |
| 2012443 | 7/1979 | United Kingdom . |

OTHER PUBLICATIONS

Copending application Ser. No. 07/060,790, Inoue et al., 6/12/87.

Copending application Ser. No. 07/067,850.

Copending application Ser. No. 07/091,928, Inoue et al., 9/1/87.

*Primary Examiner*—Paul R. Michl

*Assistant Examiner*—Patrick A. Doody

*Attorney, Agent, or Firm*—Sughrue, Mion, Zinn, Macpeak & Seas

[57] ABSTRACT

A method for the formation of direct positive color images wherein after image-wise exposure of a direct positive color photosensitive material which comprises at least one internal latent image type silver halide emulsion layer which has not been pre-fogged and color image forming couplers on a support, the material is subjected to development after and/or during a fogging process, the development process being carried out using a development bath which contains at least one N-hydroxylalkyl substituted p-phenylenediamine derivative in the presence of at least one compound of general formula [I] and/or [II] as indicated below:

(I)

wherein

Q represents the group of atoms required to form a five- or six-membered heterocyclic ring, which heterocyclic ring may be condensed with a carbon aromatic ring or a heterocyclic aromatic ring, Y represents a divalent linking group consisting of at least one atom selected from the group consisting of, carbon atom, nitrogen atom, oxygen atom, sulfur atom, and R represents an organic group which includes at least one thioether group, amino group, ammonium group, ether group or heterocyclic group, n represents 0 or 1, m represents 0, 1 or 2, M represents a hydrogen atom, alkali metal atom, ammonium group or a group which is cleaved under alkaline conditions;

(II)

wherein

Q' represents the group of atoms required to form a five or six membered heterocyclic ring which can form imino silver, Y, R, n and M are the same as those in general formula [I], and m' represents 1 or 2.

6 Claims, No Drawings

METHOD FOR THE FORMATION OF DIRECT POSITIVE COLOR IMAGES

FIELD OF THE INVENTION

The present invention is directed toward a method for the formation of photographic images, and more particularly it is directed a method for the formation of direct positive images having excellent gradation.

BACKGROUND OF THE INVENTION

Methods of obtaining direct positive images using internal latent image type silver halide emulsions, which have not been pre-fogged by carrying out surface development either after or during the execution of a post-exposure fogging treatment, are well known.

The abovementioned internal latent image type silver halide photographic emulsion is a silver halide emulsion having photosensitive nuclei principally within the silver halide grains and with which the latent image formed by exposure to light is formed principally within the grains.

Various techniques for obtaining direct positive images are known. The principal techniques have been disclosed in U.S. Pat. Nos. 2,592,250, 2,466,957, 2,497,875, 2,588,982, 3,317,322, 3,761,266, 3,761,276 and 3,796,577, and British Patent Nos. 1,151,363, 1,150,553 and 1,011,062.

Comparatively high speed photographic materials can be obtained as direct positive type materials when utilizing these known methods.

Details of the formation and structure of the above mentioned positive image materials have been described by T. H. James in "*The Theory of the Photographic Process*", fourth edition (1977), chapter 7, pages 182–193, and in U.S. Pat. No. 3,761,276.

Fogging nuclei are produced selectively on the unexposed surfaces of the silver halide grains as a result of surface sensitivity reducing action brought about by the so-called internal latent image which is produced within the silver halide grains by the initial imagewise exposure; subsequently a photographic image (direct positive image) is formed in the unexposed parts of the grains by the execution of a normal so-called surface development process.

Known techniques for selectively forming the fogging nuclei as described above include, in general, "Light fogging methods" in which the whole photosensitive layer is subjected to a second exposure (as in British Patent No. 1,151,363) and "chemical fogging methods" in which a nucleating agent is used. The latter chemical fogging methods are discussed on pages 76–78 of *Research Disclosure* Vol. 151, No. 15162 (November, 1976).

A surface color developing process is carried out either after subjecting the internal latent image type silver halide photosensitive material to a fogging treatment or while executing such a treatment. The material is then subjected to bleaching and fixing processes (or a bleach-fix process) to form the direct positive color image. The material is further subjected to a normal water washing and/or stabilization process after the bleaching and fixing processes.

When forming a direct positive image using either the light fogging method or the chemical fogging method, the rate of development of the direct positive type material is slow and the processing time is longer than that of a normal negative type material. Thus, methods to shorten the processing time have been adopted, by raising the pH and/or the temperature of the development bath. However, there is a problem in that the minimum image density (Dmin) of the direct positive image obtained is generally increased at high pH. Further, the developing agent is liable to deteriorate as a result of aerial oxidation under conditions of high pH. Also, the pH is liable to be reduced by the absorption of carbon dioxide from the air. This results in a marked lowering of development activity.

N-Hydroxyalkyl substituted p-phenylenediamine derivatives are known developing agents which have a high level of development activity and which provide adequate maximum densities (Dmax). However, although a high maximum image density is obtained when direct positive images are formed using the abovementioned compounds, there is also a simultaneous increase in the minimum image density and thus there is a tendency towards softer gradation. It is therefore desirable to remedy these problems.

Accordingly, it is the objective of the present invention is to provide a method for forming direct positive color images having both a high maximum image density of 2.0 or more and a low minimum image density of 0.15 or less.

A further objective of the present invention is to provide a method for forming direct positive color images having excellent gradation and being suitable for practical applications.

SUMMARY OF THE INVENTION

The objectives of the present invention are realized by means of a method for the formation of direct positive color images. In a direct positive color image forming method after imagewise exposure, a direct positive color photosensitive material which contains at least one internal latent image type silver halide emulsion layer which has not been pre-fogged and color image forming couplers on a support is subjected to a development process after and/or during the execution of a fogging process. The development process is carried out using a development bath which contains N-hydroxyalkyl substituted p-phenylenediamine derivatives in the presence of at least one type of compound of general formula (I) and/or (II) as indicated below.

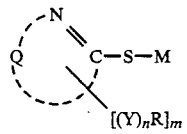

(I)

In formula (I), Q represents the group of atomic group required to form a five or six membered heterocyclic ring. Examples of the heterocyclic ring include a pyridine ring, a pyrimidine ring, a triazine ring, a triazole ring, and an imidazole ring. Furthermore, this heterocyclic ring may be condensed with a carbon aromatic ring having from 6 to 12 carbon atoms or a heterocyclic aromatic ring having from 6 to 12 carbon atoms.

Y represents a divalent linking group consisting of at least one atom selected from the group consisting of carbon atom, nitrogen atom, oxygen atom, or sulfur atom.

Examples of the divalent linking group include

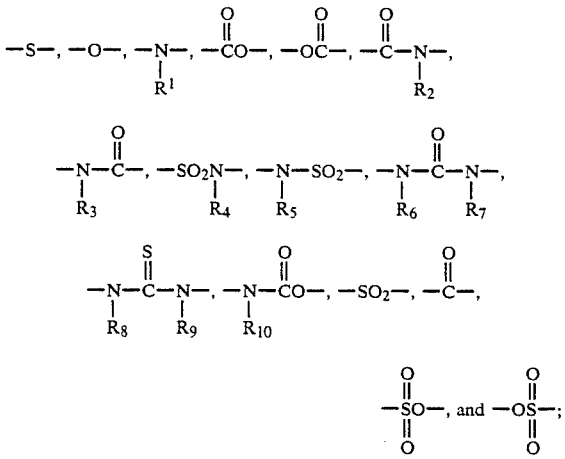

wherein $R_1$, $R_2$, $R_3$, $R_4$, $R_5$, $R_6$, $R_7$, $R_8$, $R_9$, $R_{10}$ each represents a hydrogen atom, a substituted or unsubstituted alkyl group (e.g , ethyl, propyl, n-butyl), a substituted or unsubstituted aryl group (e.g., phenyl, 2-methylphenyl), a substituted or unsubstituted alkenyl group (e.g., propenyl, 1-methylvinyl), or a substituted or unsubstituted aralkyl group (e.g., benzyl, phenethyl).

R represents an organic group which includes at least one thioether group, amino group, ammonium group (including a salt form), ether group or heterocyclic group (including a salt form).

Such an organic group includes a group formed by incorporating the above-mentioned group with a group selected from a substituted or unsubstituted alkyl group, a substituted or unsubstituted alkenyl group, a substituted or unsubstituted aralkyl group and a substituted or unsubstituted aryl group, but it may be a combination of these groups. Examples of the organic group include a hydrochloride of a dimethylaminoethyl group, an aminoethyl group, a diethylaminoethyl group, a dibutylaminoethyl group, or a dimethylaminopropyl group, a dimethylaminoethylthioethyl group, a 4-dimethylaminophenyl group, a 4-dimethylaminobenzyl group, a methylthioethyl group, an ethylthiopropyl group, a 4-methylthio-3-cyanophenyl group, a methylthiomethyl group, a trimethylammonioethyl group, a methoxyethyl group, a methoxyethoxyethoxyethyl group, a methoxyethylthioethyl group, a 3,4-dimethoxyphenyl group, a 3-chloro-4-methoxyphenyl group, a morpholinoethyl group, a 1-imidazolylethyl group, a morpholinoethylthioethyl group, a pyrroridinoethyl group, a piperidinopropyl group, a 2-pyridylmethyl group, a 2-(1-imidazolyl)ethylthioethyl group, a pyrazolylethyl group, a triazolylethyl group, and a methoxyethoxyethoxyethoxycarbonylaminoethyl group.

Moreover n represents 0 or 1 and m represents 0, 1 or 2. M represents a hydrogen atom, alkali metal atom, ammonium group or a group which is cleaved under alkaline conditions;

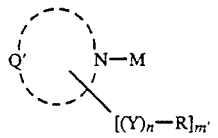

(II)

In formula (II), Q' represents the group of atoms required to form a five or six membered heterocyclic ring which can form imino silver and Y, R, n and M are the same as those in the aforementioned general formula (I) Moreover, m' represents 1 or 2.

The nucleating accelerators represented by the aforementioned general formula (I) are described in more detail below.

The term "nucleating accelerator" is defined as a material which has virtually no nucleating (fogging) action on silver halide grains but which serves to accelerate the above-mentioned nucleating action.

The use of compounds of the aforementioned general formula (I) which can be represented by the general formula (III), (IV), (V), and (VI) indicated below is preferred.

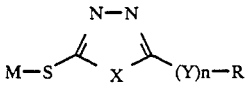

(III)

M, R, Y and n in formula (III), have the same meaning as in general formula (I). X represents an oxygen atom, sulfur atom or selenium atom. Preferably X represents a sulfur atom.

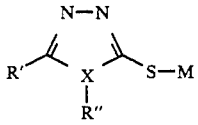

(IV)

In formula (IV), R' represents a hydrogen atom, halogen atom (for example a chlorine atom, bromine atom etc.), nitro group, mercapto group, unsubstituted amino group, substituted or unsubstituted alkyl group (for example, methyl, ethyl), a substituted or unsubstituted alkenyl group (for example, propenyl, methylvinyl), a substituted or unsubstituted aralkyl group (for example, benzyl, phenethyl), a substituted or unsubstituted aryl group (for example, phenyl, 2-methylphenyl), or a $-(Y)_n-R$ group, in which a substituent is an alkyl group having from 1 to 12 carbon atoms, preferably from 1 to 6 carbon atoms.

R'' represents a hydrogen atom, an unsubstituted amino group or a $-(Y)_n-R$ group. When R' and R'' both represent $-(Y)_n-R$ groups, these groups may be the same or different.

However, at least one of R' and R'' represents a $-(Y)_n-R$ group.

M, R, Y, and n each have the same meaning as in the aforementioned general formula (I).

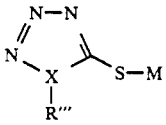

(V)

In formula (V), R''' represents a $-(Y)_n-R$ group. And M, R, Y, and n each have the same meaning as in the aforementioned general formula (I).

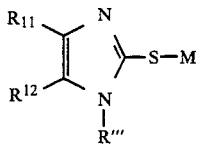

(VI)

In formula (VI), $R^{11}$ and $R^{12}$ represent hydrogen atoms, halogen atoms, substituted or unsubstituted amino groups, nitro groups, substituted or unsubstituted alkyl groups, alkenyl groups, aralkyl groups or aryl groups, in which a substituent is an alkyl group having from 1 to 12 carbon atoms, preferably from 1 to 6 carbon atoms. Moreover M and R''' each have the same meaning as in the aforementioned general formula (V).

Actual compounds which can be represented by the general formulae (II)-(VI) of this invention are indicated below, but the compounds of the invention are not limited to these compounds.

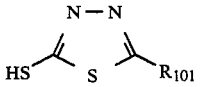

| No. | $R_{101}$ |
|---|---|
| A-1. | $-SCH_3$ |
| A-2. | $-S(CH_2)_3N(CH_3)_2.HCl$ |
| A-3. | 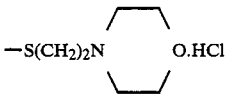 |
| A-4. | $-S(CH_2)_2\ OCH_3$ |
| A-5. | $-SCH_2SCH_3$ |
| A-6. | $-S(CH_2)_6N(CH_3)_2.HCl$ |
| A-7. | $-S(CH_2)_6N(C_2H_5)_2.HCl$ |
| A-8. | $-S(CH_2)_2S(CH_2)_2N(CH_3)_2.HCl$ |
| A-9. | 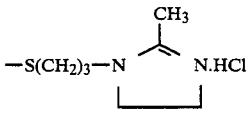 |
| A-10. | $-S(CH_2)_2\overset{\oplus}{N}(CH_3)_3.Cl^{\ominus}$ |
| A-11. | $-S(CH_2)_2NHCH_3.HCl$ |

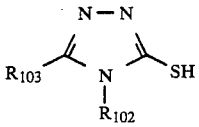

| No. | $R_{102}$ | $R_{103}$ |
|---|---|---|
| A-12. | 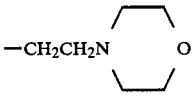 | H |
| A-13. | $-CH_3$ | H |
| A-14. | 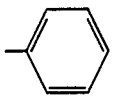 | H |
| A-15. | $-CH_2CH_2N(C_2H_5)_2$ | H |
| A-16. | $-CH_2N(CH_3)_2$ | H |

-continued

| | | |
|---|---|---|
| A-17. | $-CH_3$ | $CH_3OCH_2$ |
| A-18. | 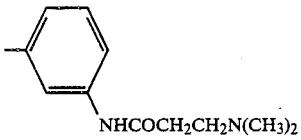 | H |
| A-19. | 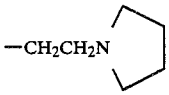 | H |
| A-20. | 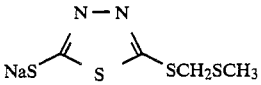 | |
| A-21. | 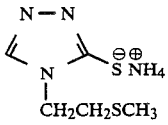 | |

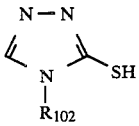

| No. | $R_{103}$ |
|---|---|
| A-22. | $-(CH_2)_2S(CH_2)_2N(CH_3)_2$ |
| A-23. | $-(CH_2)_2N(C_3H_{7-n})_2$ |
| A-24. | $-(CH_2)_3N(CH_3)_2$ |
| A-25. | $-(CH_2)_2\overset{\oplus}{N}(CH_3)_3.Cl^{\ominus}$ |
| A-26. | 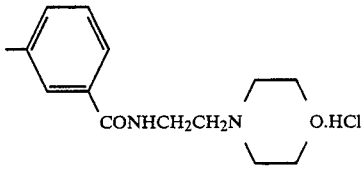 |

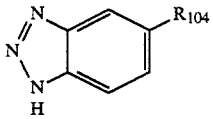

| No. | $R_{104}$ |
|---|---|
| A-27. | $-OCNH(CH_2)_2N(CH_3)_2$ |
| A-28. | $-OCNH(CH_2)_2SCH_3$ |

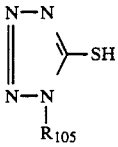

| No. | $R_{105}$ |
|---|---|
| A-29. | $-CH_3$ |
| A-30. | $-(CH_2)_2N(C_3H_{7-n})_2$ |
| A-31. | $-(CH_2)_2N(C_2H_5)_2$ |
| A-32. | $-(CH_2)_2-O-CH_3$ |
| A-33. | 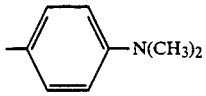 |

-continued

A-34.

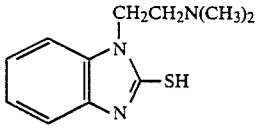

The aforementioned nucleation accelerating agents of the present invention are contained in the photosensitive material. Preferably, they are contained in the internal latent image type silver halide emulsion or in some other hydrophilic colloid layer (an intermediate layer or protective layer) within the photosensitive material. Most desirably, they are contained in a silver halide emulsion layer or in a layer adjacent to such a layer.

The amount of the nucleation accelerating agent added is preferably from $10^{-6}$ to $10^{-2}$ mol, and most desirably from $10^{-5}$ to $10^{-2}$ mol, per mol of silver halide, or preferably from $1.0\times10^{-7}$ to $1.0\times10^{-4}$ g/m$^2$, preferably from $1.0\times10^{-6}$ to $1.0\times10^{-4}$ g/m$^2$ for the adjacent layer.

Further, two or more nucleation accelerating agents can be used jointly.

The developing agents used in the present invention are quaternary ammonium salts of N-hydroxyalkyl substituted p-phenylenediamine compounds, especially the compounds which can be represented by the following general formula (D):

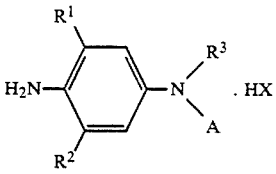

(D)

In formula (D), $R^1$ is a hydrogen atom, an alkyl group which has from 1 to 4 carbon atoms or an alkoxy group which has from 1 to 4 carbon atoms, $R^2$ is a hydrogen atom or an alkyl group which has from 1 to 4 carbon atoms, $R^3$ is an alkyl group which has from 1 to 4 carbon atoms and which may have a hydroxyl group, and A is an alkyl group having from 1 to 12 carbon atoms, preferably from 1 to 3 carbon atoms which has one or two hydroxyl groups and which may be branched. Preferably, A is a group as indicated below.

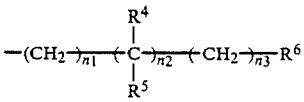

$R^4$, $R^5$ and $R^6$ each represent a hydrogen atom, a hydroxyl group or an alkyl group which has from 1 to 3 carbon atoms and which may have a hydroxyl group. At least one of $R^4$, $R^5$ and $R^6$ is a hydroxyl group or an alkyl group which has from 1 to 3 carbon atoms and a hydroxyl group. Moreover, $n_1$, $n_2$ and $n_3$ are each 0, 1, 2 or 3, and HX represents hydrochloric acid, sulfuric acid, p-toluene sulfonic acid, nitric acid or phosphoric acid.

P-phenylenediamine color developing agents of this type are unstable as free amines and therefore they are generally used in the form of salts. Typical examples include 4-amino-3-methyl-N-ethyl-N-(β-hydroxyethyl-)aniline salts and 4-amino-N-ethyl-N-(β-hydroxyethyl-)aniline salts.

Preferred N-hydroxyalkyl substituted p-phenylenediamine derivatives for use in the present invention are indicated below, but the invention is not limited to these illustrative compounds.

D-1

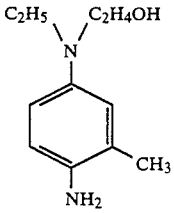

D-2

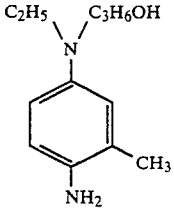

D-3

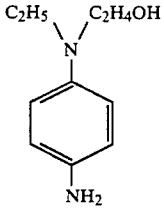

D-4

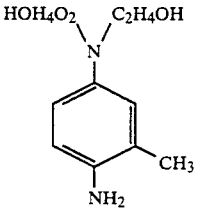

D-5

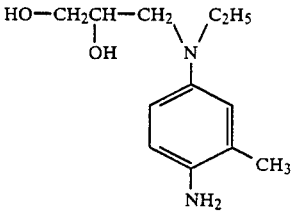

D-6

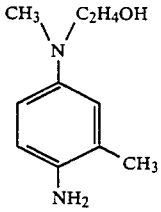

-continued

D-7

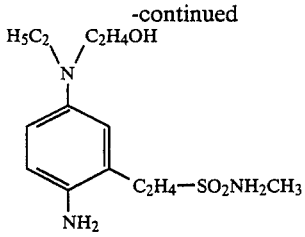

D-8

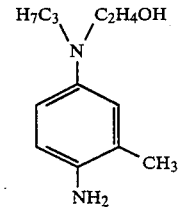

D-9

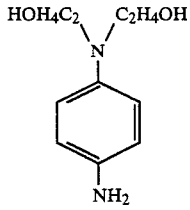

The hydrochlorides, sulfates and p-toluene sulfonates of the abovementioned compounds D1–D9 are especially desirable. The use of the compounds D-1, 2, 3, 6, 7 and 8 from among these illustrative compounds is preferred and the use of the compounds D-1, 2, 3 and 6 is especially desirable.

The color developing agents of the present invention are highly soluble in water and are preferably used in amounts ranging from 1 to 100, and most desirably in amounts within the range of from 3 to 30 g per liter of processing bath.

The N-hydroxyalkyl substituted p-phenylenediamine derivatives of the present invention are easily synthesized using the methods disclosed on page 3100, of volume 73, of the Journal of the *American Chemical Society* (1951).

These N-hydroxyalkyl substituted p-phenylenediamine derivatives can be used in combinations of two or more types and they can also be used in combination with other p-phenylenediamine based color developing agents as required. Typical examples of p-phenylenediamine based compounds which can be used in such combinations include 3-methyl-4-amino-N-ethyl-N-(β-methanesulfonamidoethyl)-aniline, 3-methyl-4-amino-N ethyl-N-methoxylethylaniline and sulfates and hydrochlorides thereof.

The color development process is carried out at temperatures of 30° C. or above, for a period up to 150 seconds, preferably at a temperature of 33° C. or above for a period of up to 120 seconds, and most desirable at a temperature of 35° C. or above for a period of up to 100 seconds. If processing is carried out at 30° C. or above for a period exceeding 150 seconds, there is a deterioration with respect to development fogging. More precisely, the processing time is more important than the temperature. If the processing time exceeds 150 seconds there is a pronounced increase in development fogging. This pronounced increase in development fogging is undesirable. Moreover, the development processing time signifies the time from the commencement of the fogging process to the commencement of the bleach, fix, bleach-fix and stop process, and the pre-dipping time prior to the execution of a light fogging treatment is not included in the processing time.

Development fogging increases if the processing temperature is too high. Thus, a processing temperature of at least 30° C. but not more than 50° C., and especially of at least 33° C. but not more than 48° C., is preferred. Most desirably the processing is carried out at a temperature of at least 35° C. but not exceeding 43° C.

The internal latent image type silver halide emulsion used in the present invention is an emulsion in which the surface of the silver halide grains has not been prefogged and which contains silver halide in which the latent image is formed principally within the grains. In practical terms the silver halide emulsion when coated at a fixed amount (0.5–3 g/m$^2$) onto a support, exposed for a fixed time of from 0.01 to 10 seconds and developed for 5 minutes at 18° C. in the development bath A indicated below (an internal type development bath) is such that the maximum density measured using the normal photographic densitometric method is at least five times more dense, and preferably at least 10 times more dense, than the density obtained which the emulsion is coated at the same rate as described above, exposed in the same way as described above and developed for 6 minutes at 20° C. in the development bath B indicated below (a surface type development bath).

| | |
|---|---|
| Internal Development Bath A | |
| Methol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Water to make | 1 liter |
| Surface Development Bath B | |
| Methol | 2.5 g |
| L-Ascorbic acid | 10 g |
| $NaBO_2.4H_2O$ | 35 g |
| KBr | 1 g |
| Water to make | 1 liter |

Actual examples of internal latent image type emulsions include the conversion type silver halide emulsions disclosed in U.S. Pat. No. 2,592,250 and the core/-shell type silver halide emulsions disclosed in U.S. Pat. Nos. 3,761,276, 3,850,637, 3,923,513, 4,035,185, 4,395,478 and 4,504,570, JP-A Nos. 52-156614 55-127549, 53-60222, 56-22681, 59-208540, 60-107641, 61-3137 and 62-215272 (the term "JP-A" as used herein means an "unexamined published Japanese patent application") and in the patents indicated in *Research Disclosure* No. 23510, page 236 (November, 1983).

The silver halide grains used in the present invention may have a regular crystalline form such as cubic, octahedral, dodecahedral or tetradecahedral form, or an irregular crystalline form such as a spherical form, or a tabular form in which the value of the ratio length/-thickness is at least 5. Furthermore, the above forms may be utilized alone or in combination.

The silver halide of the present invention is composed of silver chloride, silver bromide or a mixed silver halide. The use of a silver chloro(iodo)bromide, silver(iodo)chloride or silver (iodo)bromide in which the silver iodide content does not exceed 3 mol. % for the silver halide is preferred.

The average grain size of the silver halide grains is preferably not more than 2 μm and not less than 0.1 μm. And those not more than 1 μm and not less than 0.15 μm are especially desirable. The size distribution of the grains may be narrow or wide. The use of a so-called "monodisperse" silver halide emulsion which has a narrow grain size distribution such that at least 90% of all the grains in terms of the number of grains or weight are within +40%, and preferably within +20% of the average grain size is preferred in order to improve granularity and sharpness. Further, it is possible to mix two or more monodisperse silver halide emulsions which have different grain sizes or a plurality of grains which have different sensitivities at the same size, or to coat separate layers of such emulsions as a laminate of emulsion layers which have essentially the same color sensitivity, in order to achieve the gradation required of the photosensitive material. Moreover, it is possible to use mixtures or separate superposed layers of two or more polydisperse silver halide emulsions or combinations of monodisperse and polydisperse emulsions.

The silver halide emulsion used in the present invention can be chemically sensitized by the application, either individually or jointly, of sulfur or selenium sensitizers, reducing sensitizers, or precious metal sensitizers etc. to the interior or the surface of the grains. Details may be found in the patents mentioned on page 23 of *Research Disclosure* No. 17643-III (December, 1978).

The photographic emulsions used in the present invention can be spectrally sensitized by means of photographic sensitizing dyes by any known manner. Especially useful dyes are those known as cyanine dyes, merocyanine dyes and complex merocyanine dyes. These dyes can be used individually or jointly. Furthermore, the abovementioned dyes and strong color sensitizers, may be used jointly. Detailed examples as to the above may be found in the patents indicated on pages 23–24 of Research Disclosure No. 17643-IV (December, 1978).

Antifoggants or stabilizers can be included in the photographic emulsions used in the present invention in order to prevent the occurrence of fogging during the manufacture, storage or photographic processing of the photosensitive materials or to stabilize photographic performance. Detailed examples as to the above are described in *Research Disclosure* No. 17643-VI (December, 1978) and in "*Stabilization of Photographic Silver Halide Emulsion*" (Focal Press) published in 1974.

Various color couplers can be used to form direct positive color images. Color couplers are compounds that undergo a coupling reaction with the oxidized form of a primary aromatic amine based color developing agent and produce or release a dye which is essentially nondiffusible, and they are themselves preferably compounds which are fast to diffusion. Typical examples of useful color couplers include naphthol or phenol based compounds, pyrazolone or pyrazoloazole based compounds, and open chain or heterocyclic ketomethylene compounds. Actual examples of these cyan, magenta and yellow couplers for use in the present invention have been disclosed in section VII-D, page 25, of *Research Disclosure* No. 17643 (December, 1987), in *Research Disclosure* No. 18717 (November, 1979) and in JP-A No. 62-215272, and in the patents cited in these documents.

Among these compounds, the oxygen atom elimination type and nitrogen atom elimination type yellow, two equivalent couplers are typical of the yellow couplers which can be used in this invention. The α-pivaloylacetanilide based couplers are superior in terms of fastness, and especially light fastness, of the colored dye, while the α-benzoylacetanilide based couplers are preferred since they provide high color densities.

Further, the preferred 5-pyrazolone based magenta couplers for use in the present invention are those which are substituted at the 3-position with an arylamino group or an acylamino group (the sulfur atom elimination type two equivalent couplers among these).

The pyrasoloazole based couplers are the most desirable, and among these couplers the pyrazolo[5,1-c][1,2,4]triazoles, etc., disclosed in U.S. Pat. No. 3,725,067 are preferred, but the imidazo[1,2-b]pyrazoles disclosed in U.S. Pat. No. 4,500,630 are even more desirable in view of the low level of auxiliary absorption on the yellow side and the light fastness of the colored dye, and pyrazolo[1,5-b][1,2,4]triazole is especially desirable.

The naphthol based and phenol based couplers disclosed in U.S. Pat. Nos. 2,474,293 and 4,502,212 and the phenol based cyan couplers which have an alkyl group consisting of an ethyl or higher alkyl group in the meta position of the phenol ring disclosed in U.S. Pat. No. 3,772,002 are the cyan couplers preferably used in the present invention, and the use of 2,5-diacylamino substituted phenol based couplers is also desirable in view of the light fastness of the colored image.

Color couplers, couplers where the dye is formed has a suitable level of diffusibility, colorless couplers, DIR couplers which release a development inhibitor as the coupling reaction proceeds, and polymerized couplers can be used for correcting unwanted absorption in the short wavelength region of the dyes which are formed.

The standard amount of color coupler used is typically within the range of from 0.001 to 1 mol per mol of photosensitive silver halide in any one emulsion layer, and the amount used is preferably within the range of from 0.01 to 0.5 mol for the yellow coupler, within the range of from 0.03 to 0.5 mol for the magenta coupler and within the range of from 0.002 to 0.5 mol for the cyan coupler.

Color reinforcing agents can be used in the present invention for improving the color forming properties of the couplers. Typical compounds have been disclosed in JP-A No. 62-215272.

The couplers of the present invention are dissolved in high boiling point and/or low boiling point organic solvents and emulsified and dispersed in an aqueous solution of gelatin or other hydrophilic colloid by means of a high speed mixer such as a homogenizer or by producing fine particles mechanically in a colloid mill etc. or by utilizing ultrasonic techniques. The thus obtained couplers are then added to the emulsion layer. In this case it is not always necessary to use a high boiling point organic solvent, but the use of the compounds disclosed in JP-A No. 62-215272 is desirable.

The couplers of the present invention can be dispersed in a hydrophilic colloid using the method disclosed in JP-A No. 62-215272.

Photosensitive materials per the present invention may contain hydroquinone derivatives, aminophenol derivatives, amines, galic acid derivatives, catechol derivatives, ascorbic acid derivatives, colorless couplers, sulfonamidophenol derivatives, etc., as color fogging mixing agents or color mixing preventing agents. Typical examples of anti-color fogging agents and color mixing preventing agents have been disclosed in JP-A-No. 62-215272.

Various anti-color fading agents can be used in the photosensitive materials of the present invention. Typical examples of organic anti-color fading agents include hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines and ether or ester derivatives in which the phenolic hydroxyl groups of these compounds have been silylated or alkylated. Further, metal complexes as typified by (bissalicylaldoxymato)nickel complexes and (bis-N,N-dialkyldithiocarbamato)nickel complexes can also be used.

Compounds which have a hindered amine structure and a hindered phenol structure in the molecule, such as those disclosed in U.S. Pat. No. 4,268,593, are useful in preventing the deterioration of the yellow dye image due to heat, moisture and light. Further, the spiroindanes disclosed in JP-A No. 56-159644 and the chromans substituted with hydroquinone diethers or monoethers disclosed in JP-A No. 55-89835 have a desirable effect in preventing the deterioration, and especially the deterioration due to light, of the magenta dye image.

Typical examples of these anti-color fading agents have been disclosed in JP-A No. 62-215272. To achieve their intended purpose, these compounds are co-emulsified with a coupler in an amount of from about 5 to 100 wt. % with respect to the corresponding coupler The thus obtained emulsified mixture is then added to the photosensitive layer.

The introduction of ultraviolet absorbers into the layers on either side of the cyan color forming layer is effective for preventing the deterioration of the cyan dye image by heat and, more especially, by light. Further, ultraviolet absorbers can also be added to a hydrophilic colloid layer such as a protective layer. Typical examples of these compounds have been disclosed JP-A-No. 62-215172.

Gelatin can be utilized as a binding agent, or as a protective colloid for use in the emulsion and intermediate layers of the photosensitive material of the present invention. However it is also possible to use other types of hydrophilic colloids for this purpose.

The following can be added to the photosensitive materials of the present invention: dyes for the prevention of irradiation and halation, ultraviolet absorbers, plasticizers, fluorescent whiteners, matting agents, antiaerial fogging agents, coating promotors, film hardening agents, antistatic agents and slip improving agents etc. Typical examples of these additives have been disclosed on pages 25–27 of *Research Disclosure* No. 17643, sections VIII–XIII (December, 1978) and on pages 647–651 of *Research Disclosure* No. 18716 (November, 1979).

The present invention can also be applied to multilayer, multi-color photographic materials which have at least two different color sensitivities, on a support. Multi-layer natural color photographic materials normally have at least one red-sensitive emulsion layer, at least one green-sensitive emulsion layer and at least one blue-sensitive emulsion layer on a support. The order of these layers can be arranged arbitrarily as required. The preferred sequence for the arrangement of the layers is, starting from the support side, either red-sensitive, green-sensitive, and blue-sensitive, or green-sensitive, red-sensitive, and blue-sensitive. Further, each of the aforementioned emulsion layers may consist of two or more emulsion layers which have different sensitivities. Also, insensitive layer may be present between two or more emulsion layers having the same color sensitivity. Cyan forming couplers are normally included in the red-sensitive emulsion layers, magenta forming couplers are normally included in the green-sensitive layer and yellow forming couplers are normally included in the blue-sensitive layer. However, different combinations can be used depending upon the particular case.

Photosensitive materials of the present invention preferably include suitable auxiliary layers such as protective layers, intermediate layers, filter layers, antihalation layers, backing layers, white-light reflecting layers, etc., in addition to the silver halide emulsion layers.

The photographic emulsion layers and other auxiliary layers include in the photographic materials of the present invention are coated onto a support as disclosed on page 28 of *Research Disclosure* No. 17643, section XVII (December, 1978) or in European Pat. No. 0,182,253 or JP-A-No. 61-97655. Furthermore the methods of coating disclosed on pages 28–29 of *Research Disclosure* No. 17643 section XV can be used.

The present invention can be applied to various color photosensitive materials including color reversal films for slide or television purposes, color reversal papers and instant color films. Further, it can also be applied to color hard copy, for preserving CFT images and for use with full color copying machines. The present invention can also be applied to monochrome color sensitive materials in which tricolor coupler mixtures are used, as disclosed in *Research Disclosure* No. 17123 (July, 1978).

The fogging treatment of the present invention may be carried out using either the aforementioned "light fogging method" in which a second exposure is applied to the whole surface of the photosensitive layer, or the aforementioned chemical fogging method in which the development process is carried out in the presence of a nucleating agent. The development process may also be carried out in the presence of a nucleating agent and fogging light. Further, a photosensitive material which contains a nucleating agent may be subjected to a fogging exposure.

The whole surface exposure (i.e., the fogging exposure), in the light fogging method of the present invention is carried out after imagewise exposure before the development process and/or during the development process.

The imagewise exposed photosensitive material is exposed in the development bath or after immersion in a pre-bath, for example, water or an aqueous alkaline or acidic solution, which may contain a salt before the development bath or on removal from these baths without drying. The exposure is preferably carried out in the development bath.

A light source within the photosensitive wavelength of the photosensitive material may be used for the fogging exposure Suitable light sources include fluorescent lamps, tungsten lamps, xenon lamps, and sunlight. Actual methods have been disclosed in British Pat. No. 1,151,363, JP-B-No. 45-12710 (the term "JP-B" as used herein means an "examined Japanese patent publication"), JP-B-Nos. 45-12709 and 58-6936, and in JP-A-Nos. 48-9727, 56-137350, 57-129438, 58-62652, 58-60739, 58-70223 (U.S. Pat. No. 4,440,851), JP-A-No. 58-120248 (European Patent Publication No. 89101A2).

Light sources which have a high color rendition (approaching as near as possible to white) including those disclosed in JP-A-Nos. 56-137350 and 58-70223 are best suited for photosensitive materials which are sensitive to light in all wavelength (i.e., color-photosensitive materials). The illuminance is generally from 0.01 to 2,000 lux, preferably from 0.05 to 30 lux, and most desirably from 0.05 to 5 lux. Sensitizing with lower illuminance is preferred with photosensitive materials in which higher speed emulsions are used. The illuminance may be adjusted by: changing the luminous intensity of the light source, by reducing the illuminance with various filters, by changing the distance between the photosensitive material and the light source or by changing the angle between the photosensitive material and the light source. Weak light can be used in the initial stage of the exposure and then a more intense light can be used, thereby shortening the exposure time.

Preferably, the light irradiation (light fogging exposure) is carried out after the photosensitive material has been immersed in the development bath or the pre-bath and the pre-bath liquid has adequately permeated into the emulsion layer of the photosensitive material to such an extent that the swelling of the emulsion layer becomes about one-half of the swelling at the saturation. The duration of time from the immersion of the material in the liquid prior to the light fogging exposure, to the exposure, is generally from 2 seconds to 2 minutes, preferably from 5 seconds to 1 minute, and most desirably from 10 seconds to 30 seconds.

The fogging exposure time is generally from 0.01 second to 2 minutes, preferably from 0.1 second to 1 minute, and most desirably from 1 second to 40 seconds.

Past compounds developed in view of the nucleation of internal latent image type silver halides can be used as nucleating agents in the present invention. Combinations of two or more types of nucleating agents may also be used. These substances are disclosed on pages 50–54 of *Research Disclosure* No. 22534 (January, 1983), pages 76–77 of *Research Disclosure* No. 15162 (November, 1976) and pages 346–352 of *Research Disclosure* No. 23510 (November, 1983). Further, they can be classified broadly into three types, namely quaternary heterocyclic compounds (compounds which can be represented by the following general formula [N-I]), hydrazine based compounds (compounds which can be represented by the following general formula [N-II]), and other compounds.

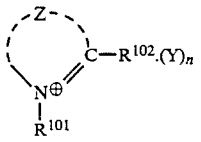

(N-I)

Z represents a group of non-metallic atoms which are required to form a five- or six-membered heterocyclic ring such as a quinoline ring, a benzothiazole ring, a 1,2,3,4-tetrahydroacridine ring, a 2,3-pentamethylenequinoline ring, and a pyridine ring, and Z may be substituted with substituent groups.

Examples of the substituent groups include a nitro group, a halogen atom (e.g., Cl, Br), a mercapto group, a cyano group, a substituted or unsubstituted alkyl group (e.g., ethyl, methyl, propyl, tert-butyl, cyanoethyl), an aryl group (e.g., phenyl, 4-methanesulfonamidophenyl, 4-methylphenyl, 3,4-dichlorophenyl, naphthyl), an alkenyl group (e.g., allyl), an aralkyl group (e.g., benzyl, 4-methylbenzyl, phenethyl), a sulfonyl group (e.g., methanesulfonyl, ethanesulfonyl, p-toluenesulfonyl), a carbamoyl group (e.g., unsubstituted carbamoyl, methylcarbamoyl, phenylcarbamoyl), a sulfamoyl group (e.g., unsubstituted sulfamoyl, methylsulfamoyl, phenylsulfamoyl), a carbonamido group (e.g., acetamido, benzamido), a sulfonamido group (e.g., methanesulfonamido, benzenesulfonamido, p-toluenesulfonamido), an acyloxy group (e.g., acetoxyl, benzoyloxyl), a sulfonyloxyl group (e.g, methanesulfonyloxyl), a ureido group (e.g., unsubstituted ureido, methylureido, ethylureido, phenylureido), a thioureido group (e.g., unsubstituted thioureido, methylureido), an acyl group (e.g., acetyl, benzoyl), an alkyl- or aryloxycarbonyl group (e.g., methoxycarbonyl, phenoxycarbonyl), an alkyl- or aryl-oxycarbonylamino group (e.g., methoxycarbonylamino, phenoxycarbonylamino, 2-ethylhexyloxycarbonylamino), a carboxylic acid or a salt thereof, a sulfonic acid or a salt thereof, and a hydroxyl group.

$R^{101}$ is an aliphatic group and $R^{102}$ is a hydrogen atom, aliphatic qroup or an aromatic group. $R^{101}$ and $R^{102}$ may be substituted with substituent groups. Furthermore, $R^{102}$ and Z may be joined together to form a ring. However, at least one of the groups represented by $R^{101}$, $R^{102}$ and Z represents an alkynyl group, acyl group, hydrazino group or a hydrazano group, or $R^{101}$ and $R^{102}$ form a six-membered ring and a dihydropyridinum skeleton is formed. Moreover, at least one of the substituent groups of $R^{101}$, $R^{102}$ and Z may have an $X^1$—$(L^1)_m$— group. Here $X^1$ is a group which promotes adsorption on silver halide, and $L^1$ is a divalent linking group. Y is a counter ion for balancing the electrical charge, n is 0 or 1 and m is 0 or 1.

Specific examples of compounds which can be represented by general formula [N-I] are given below.

| | |
|---|---|
| (N-I-1) | 5-Ethoxy-2-methyl-1-propargylquinolinium bromide |
| (N-I-2) | 2,4-Dimethyl-1-propargylquinolimium bromide |
| (N-I-3) | 2-Methyl-1-{3-[2-(4-methylphenyl)hydrazono]-butyl}quinolinium iodide |
| (N-I-4) | 3,4-Dimethyl-dihydropyrrolido[2,1-b]benzothiazolium bromide |
| (N-I-5) | 6-Ethoxythiocarbonylamino-2-methyl-1-propargylquinolinium trifluoromethanesulfonate |
| (N-I-6) | 2-Methyl-6-(3-phenylthioureido)-1-propargylquinolinium bromide |
| (N-I-7) | 6-(5-Benzotriazolecarboxamido)-2-methyl-1-propargylquinolinium trifluoromethanesulfonate |
| (N-I-8) | 6-[3-(2-Mercaptoethyl)ureido]-2-methyl-2-progargylquinolinium trifluoromethanesulfonate |
| (N-I-9) | 6-{3-[3-(5-mercapto-1,3,4-thiadiazol-2-ylthio)-propyl]ureido}-2-methyl-1-propargylquinolinium trifluoromethanesulfonate |
| (N-I-10) | 6-(5-Mercaptotetrazol-1-yl)2-methyl-1-propargylquinolinium iodide |
| (N-I-11) | 1-Propargyl-2-(1-propenyl)quinolinium trifluoromethanesulfonate |
| (N-I-12) | 6-Ethoxythiocarbonylamino-2-(2-methyl-1-propenyl)-1-propargylquinolinium trifluoromethanesulfonate |
| (N-I-13) | 10-Propargyl-1,2,3,4-tetrahydroacridinium trifluoromethanesulfonate |
| (N-I-14) | 7-Ethyoxythiocarbonylamino-10-propargyl-1,2,3,4-tetrahydroacridinium trifluoromethanesulfonate |
| (N-I-15) | 6-Ethoxythiocarbonylamino-1-propargyl-2,3-pentamethylenequinolinium trifluoromethane-sulfonate |
| (N-I-16) | 7-[3-(5-Mercaptotetrazol-1-yl)benzamido]-10-propargyl-1,2,3,4-tetrahydroacridinium perchlorate |
| (N-I-17) | 6- [3-(5-Mercaptotetrazol-1-yl)benzamido]-1-propargyl-2,3-pentamethylenequinolinium bromide |
| (N-I-18) | 7-(5-Mercaptotetrazol-1-yl)-9-methl-10- |

-continued

| | |
|---|---|
| | propargyl-1,2,3,4-tetrahydroacridinium bromide |
| (N-I-19) | 7-[3-{N-[2-(5-mercapto-1,2,4-thiadiazol-2-yl)-thioethyl]carbamoyl}propanamido]-10-propargyl-1,2,3,4-tetrahydroacridinium tetrafluoroborate |
| (N-I-20) | 6-(5-Mercaptotetrazol-1-yl)-4-methyl-1-propargyl-2,3-pentamethylenequinolinium bromide |
| (N-I-21) | 7-Ethoxythiocarbonylamido-10-propargyl-1,2,-dihydroacridinium trifluoromethanesulfonate |
| (N-I-22) | 7-(5-Mercaptotetrazol-1-yl)-9-methyl-10-propargyl-1,2-dihydroacridinium hexafluoro-phosphate |
| (N-I-23) | 7-[3-(5-Mercaptotetrazol-1-yl)benzamido]-10-propargyl-1,2-dihydroacridinium bromide |
| (N-II) | $R^{121}-\underset{\underset{R^{123}}{\vert}}{N}-\underset{\underset{R^{124}}{\vert}}{N}-G-R^{122}$ |

$R^{121}$ represents an aliphatic group, aromatic group or a heterocyclic group, $R^{122}$ represents a hydrogen atom, alkyl group, aralkyl group, aryl group, alkoxy group, aryloxy group or an amino group, G represents a carbonyl group, sulfonyl group, sulfoxy group, phosphoryl group or an iminomethylene group (NH=C<), and $R^{123}$ and $R^{124}$ both represent hydrogen atoms or one represents a hydrogen atom and the other represents an alkylsulfonyl group, arylsulfonyl group or an acyl group. Furthermore, a hydrazone structure (>N—N=C<) may be formed containing G, $R^{123}$, $R^{124}$ and the hydrazine nitrogen. Further, the groups mentioned above can, where possible, be substituted with substituent groups.

Specific examples of compounds which can be represented by general formula [N-II] are given below.

| | |
|---|---|
| (N-II-1) | 1-Formyl-2-{4-[3-(2-methoxyphenyl)ureido]-phenyl}hydrazine |
| (N-II-2) | 1-Formyl-2-{4-[3-{3-[3-(2,4-di-tert-pentyl-phenoxy)propyl]ureido}phenylsulfonyl-amino]phenyl}hydrazine |
| (N-II-3) | 1-Formyl-2-{4-[3-(5-mercaptotetrazol-1-yl)-benz-emido]phenyl}hydrazine |
| (N-II-4) | 1-Formyl-2-[4-{3-[3-(5-mercaptotetrazol-1-yl)phenyl]ureido}phenyl]hydrazine |
| (N-II-5) | 1-Formyl-2-[4-{3-[N-(5-mercapto-4-methyl-1,2,4-triazol-3-yl)carbamoyl)propanamido}phenyl]-hydrazine |
| (N-II-6) | 1-Formyl-2-{4-[3-{N-[4-(3-mercapto-1,2,4-triazol-4-yl)phenyl]carbamoyl}propanamido]-phenyl}hydrazine |
| (N-II-7) | 1-Formyl-2-[4-{3-[N-(5-mercapto-1,3,4-thiadiazol-2-yl)carbamoyl]propanamido}-phenyl]hydrazine |
| (N-II-8) | 2-[4-(Benzotriazol-5-carboxamido)phenyl]-1-formylhydrazine |
| (N-II-9) | 2-[4-{3-N-(Benzotriazol-5-carboxamido)-carbamoyl]propanamido}phenyl-1-formyl-hydrazine |
| (N-II-10) | 1-Formyl-2-{4-[1-(N-phenylcarbamoyl)thio-semicarbamido]phenyl}hydrazine |
| (N-II-11) | 1-Formyl-2-{4-[3-(3-phenylthio-ureido)benzamido]phenyl}hydrazine |
| (N-II-12) | 1-Formyl-2-[4-(3-hexylureido)phenyl]hydrazine |
| (N-II-13) | 1-Formyl-2-{4-[3-(5-mercaptotetrazol-1-yl)benzenesulfonamido]phenyl}hydrazine |
| (N-II-14) | 1-Formyl-2-{4-[3-{3-[3(5-mercaptotetrazol-1-yl)phenyl]ureido}benzenesulfonamido]phenyl}-hydrazine |

The nucleating agents used in the present invention can be included in the sensitive material or in the processing bath for the sensitive material. However, they are preferably included in the sensitive material.

When the nucleating agents are included in the sensitive material the amount used is preferably within the range from $10^{-8}$ to $10^{-2}$ mol, and more desirably within the range from $10^{-7}$ to $10^{-3}$ mol, per mol of silver halide. Other useful hydrazine based nucleating agents have been disclosed in JP-A-No. 57-86829 and U.S. Pat. Nos. 4,560,638, 4,478,928, 2,563,785 and 2,588,982.

Further, in cases where the nucleating agent is added to the development bath, the amount used of the nucleating agent is preferably from $10^{-8}$ to $10^{-3}$ mol, and most desirably from $10^{-7}$ to $10^{-4}$ mol, per liter.

The compounds given below can be added to raise the maximum image density, reduce the minimum image density, improve the storage properties of the photosensitive material or increase the rate of development of the sensitive material.

Hydroquinones (for example the compounds disclosed in U.S. Pat. Nos. 3,227,552 and 4,279,987), chromans (for example the compounds disclosed in U.S. Pat. No. 4,268,621, JP-A-No. 54-103031 and on pages 333–334 of *Research Disclosure* No. 18264 (June, 1979)), quinones (for example the compounds disclosed on pages 433–434 of *Research Disclosure* No. 21206 (December, 1981)), amines (for example the compounds disclosed in U.S. Pat. No. 4,150,993 and JP-A-No. 58-174757, oxidizing agents (for example the compounds disclosed in JP-A-No. 60-260039 and on pages 10–11 of *Research Disclosure* No. 16936 (May, 1978)), catechols (for example the compounds disclosed in JP-A-No. 55-21013 and JP-A-No. 55-65944), compounds which release nucleating agents at the time of development (for example the compounds disclosed in JP-A-No. 60-107029), thioureas (for example the compounds disclosed in JP-A-No. 60-95533), and spirobisindanes (for example the compounds disclosed in JP-A-No. 55-65944).

Color development baths which contain the aforementioned N-hydroxyalkyl substituted p-phenylenediamine derivatives of the present invention generally contain pH buffers, such as the carbonates, borates or phosphates of alkali metals, and development inhibitors or antifoggants such as bromides, iodides, benzimidazoles, benzothiazoles or mercapto compounds. Further, they may also contain various preservatives, such as hydroxylamine, diethylhydroxylamine, sulfites, hydrazines, phenylsemicarbazides, triethanolamine, catechol sulfonic acids and triethylenediamine(1,4-diazabicyclo[2,2,2]octanes), organic solvents such as ethylene glycol and diethylene glycol, development accelerators such as benzyl alcohol, poly(ethylene glycol), quaternary ammonium salts and amines, dye forming couplers, competitive couplers, fogging agents such as sodium borohydride, auxiliary developing agents such as 1-phenyl-3-pyrazolidone, viscosity imparting agents, various chelating agents typified by the aminopolycarboxylic acids, aminopolyphosphonic acids, alkylphosphonic acids and phosphonocarboxylic acids, of which typical examples include ethylenediamine tetra-acetic acid, nitrilotriacetic acid, diethylenetriaminepentaacetic acid, cyclohexanediaminetetraaceitic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine di(o-hydroxyphenylacetic acid), and salts of these compounds, as required.

The pH of these color developers is generally within the range of from 9 to 12, and preferably within the range of from 9.5 to 11.5.

The replenishment rate of the development bath depends on the color photographic material which is being processed. Generally, the replenishment rate is less than 1 liter per square meter of photosensitive material and it is possible, by reducing the bromide ion concentration in the replenisher, to use a replenishment rate of not more than 300 ml per square meter of photosensitive material. When the replenishment rate is reduced, it is desirable to prevent evaporation of the development bath by minimizing the contact area of the bath and the air in the processing tank. Furthermore, the replenishment rate can be reduced by using a means of suppressing the accumulation of bromide ion in the developer.

The photographic emulsion layers are subjected to a conventional bleaching process after color development. The bleaching process may be carried out at the same time as a conventional fixing process (in a conventional bleach-fix process) or it may be carried out as a separate process. Moreover, a conventional bleach-fix process can be carried out after a bleach process in order to speed-up processing. Also, processing can be carried out in two connected bleach-fix baths, a fixing process can be carried out before carrying out a bleach-fix process or a bleach process can be carried out after a bleach-fix process. Compounds of a polyvalent metal including iron (III), cobalt (III), chromium (VI), copper (II), peracids, quinones, nitrocompounds can be used as bleaching agents. Typical bleaching agents include ferricyanides; dichromates; organic complex salts of iron (III) or cobalt (III), for example, complex salts with aminopolycarboxylic acids such as ethylenediamine tetra-acetic acid, diethylenetriaminepentaacetic acid, cyclohexanediaminetetraacetic acid, methyliminodiacetic acid, 1,3-diaminopropanetetracetic acid, glycol ether diamine tetraacetic acid, or citric acid, tartaric acid, malic acid; persulfates; bromates; permanganates and nitrobenzenes. The use of the aminopolycarboxylic acid iron (III) complex salts, principally ethylenediaminetetraacetic acid iron (III) complex salts, and persulfates, is preferred in view of both rapid processing and the prevention of environmental pollution. Moreover, the amino polycarboxylic acid iron(III) complex salts are especially useful in both bleach baths and bleach-fix baths. The pH value of bleach or bleach-fix baths in which the aminopolycarboxylic acid iron(III) complex salts are used is normally from 5.5 to 8, but processing can be carried out at lower pH values to speed-up the processing.

Bleach accelerators can be used, as required, in the bleach baths, bleach-fix baths, bleach pre-baths or bleach-fix pre-baths. Actual examples of useful bleach accelerators have been disclosed in the following specifications: U.S. Pat. No. 3,893,858, West German Pat. No. 1,290,812, JP-A-No. 53-95630 and *Research Disclosure* No. 17,129 (July, 1978) (compounds having a mercapto group or a disulfide bond); JP-A-No. 50-140129 (thiazolidine derivatives); U.S. Pat. No. 3,706,561 (thiourea derivatives); JP-A-No. 58-15235 (iodides); West German Pat. No. 2,748,430 (polyoxyethylene compounds); JP-B-No. 45-8836 (polyamine compounds); and bromide ion. Among these compounds, those which have a mercapto group or a disulfide group are preferred due to their accelerating effect. Further, the use of the compounds disclosed in U.S. Pat. No. 3,893,858, West German Pat. No. 1,290,812 and JP-A-No. 53-95630 is especially desirable. Moreover, the use of the compounds disclosed in U.S. Pat. No. 4,552,834 is also desirable. the above described bleach accelerators may be added to the sensitive material. These bleach accelerators are especially effective when bleach-fixing color photosensitive materials for photographic purposes.

Thiosulfates, thiocyanates, thioether based compounds, thioureas and large quantities of iodides can be used as fixing agents. Generally, thiosulfates are used as fixing agents. More specifically, ammonium thiosulfate can effectively utilized. Sulfites, bisulfites, or carbonyl-bisulfite addition compounds, are the preferred preservatives for bleach-fix baths.

After being subjected to desilvering, the silver halide color photographic material of the present invention is normally rinsed and/or stabilized. The amount of water to be used in the rinse step canbe varied widely depending on the properties of the light-sensitive material (e.g., coupler), the application of the light-sensitive material, the temperature of the rinsing water, the number of rinsing tanks (number of stages), the replenishment system (i.e., countercurrent or cocurrent), and other various conditions. The relationship between the number of rinsing tanks and the amount of water to be used in a multistage countercurrent system can be determined by a method described in "*Journal of the Society of Motion Picture and Television Engineers*", Vol. 64, pp. 248–253 (May, 1955).

In the multistage countercurrent process described in the above-cited reference, the amount of rinsing water to be used can be drastically reduced. However, the multistage countercurrent proces is disadvantagerous in that the time of water retention in the tank is increased, causing proliferation of bacteria which produces suspended materials that will be attached to the light-sensitive material. In the present process for the processing of a light-sensitive material, the approach described in JP-A-No. 62-288838, which comprises reducing the calcium and magnesium ion concentration, can be effectively used to overcome such a problem. Such a problem can also e solved by the use of a proper sterilizer such as isothiazolone compound and thiabenzazoles described in JP-A-No. 57-8542, chlorine sterilizer (e.g., sodium chlorinated isocyanurate), and sterilizers described in "*Chemistry of Biocides and Fungicides*" (1982) by Horiguchi; "*Reduction of Microorganisms, Biocidal and Fungicidal Techniques*" (1982) published by the Health and Hygiene Technical Society and in "*A Dictionary of Biocides and Fungicides*" (1985) published by the Japanese Biocide and Fungicide Society.

The pH value of the wash water used in the processing of the photosensitive materials in accordance with the present invention is generally within the range of from 4 to 9, and preferably within the range of from 5 to 8. The wash water temperature and the washing time can vary according to the characteristics of the photosensitive material and the particular application. The washing time may be of from 20 seconds to 10 minutes at a temperature of from 15° to 45° C. However, a washing time of from 30 seconds to 5 minutes at a temperature of from 25° to 40° C. is preferred. Moreover, the photosensitive materials of the present invention can be processed directly in a stabilizing bath instead of being subjected to a water wash as described above. Known methods such as those disclosed in JP-A-Nos. 57-8543, 59-14834 and 60-200345 can be used for such a stabilization process.

The overflow accompanying replenishment of the above mentioned wash water and/or stabilizer can be reused in other processes (i.e., a desilvering process).

A color developing agent may also be incorporated into the silver halide color photosensitive materials of the prsent invention to simplify and speed-up processing. The incorporation of various color developing agent precursors is preferred. For example, indoaniline based compounds disclosed in U.S. Pat. No. 3,342,597, Schiff's base type compounds disclosed in U.S. Pat. No. 3,342,599 and in *Research Disclosure* Nos. 14850 and 15159, aldol compounds disclosed in *Research Disclosure* No. 13924, the metal salt complexes disclosed in U.S. Pat. No. 3,719,492, and the urethane based compounds disclosed in JP-A-No. 53-135628, can be used for this purpose.

Various 1-phenyl-3-pyrazolidones may also be incorporated, as required, into the silver halide color photosensitive materials of the present invention with a view to accelerating color development. Typical compounds of this type have been disclosed in JP-A-Nos. 56-64339, 57-144547 and 58-115438.

The present processing baths are used at a temperature of from about 10° to 50° C. The standard temperature of the various processing baths is normally of from 33° to 38° C. Processing is accelerated and the processing time is shortened when higher temperatures are utilized. However, increased picture quality and improved stability of the processing baths can be achieved when lower temperatures are utilized. Further, processes utilizing hydrogen peroxide intensification of cobalt intensification disclosed in West German Pat. No. 2,226,770 or U.S. Pat. No. 3,674,499 can be carried out to economize on silver in the photosensitive material.

A low replenishment rate is preferred in each of the processing stages. The amount of replenisher per unit area of photosensitve material is preferably from about 0.1 to 50 times, and most desirably from about 3 to 30 times the amount of the liquid (per unit area of photosensitive material) carried over with the photosensitive material from the previous bath.

The invention is described in detail with reference to the following Examples, but the invention is not construed as being limited thereto.

EXAMPLE 1

A color photographic material was prepared by coating the first to the fourteenth layers indicated below onto the surface (surface 1) of a paper support (thickness, 100 μm) which had been laminated on surface 1 with a polyethylene 25 μm thick and on the opposite surface (surface 2) with a polyethyelne 20 μm thick and by coating the fifteenth and sixteenth layers indicated below onto surface 2 of the support. The polyethylene on surface 1 contained titanium white (4.0 g/m$^2$) as a white pigment and a trace of ultramarine blue (0.0005 g/m$^2$) as a blue dye.

Composition of the Photosensitive Layer

The components and the coated weights in units of g/m$^2$ are indicated below. Moreover, the amount of silver halide coated is shown after calculation as silver. The emulsions used in each layer were prepared in accordance with the method used to prepare the emulsion EM-1. However, the emulsion of the fourteenth layer was a Lippmann emulsion whose surface had not been sensitized.

| | g/m$^2$ |
|---|---|
| First Layer (Anti-halation Layer) | |
| Black coloidal silver (average grain size 0.04 μm) | 0.10 |
| Gelatin | 1.30 |
| Second Layer (Intermediate Layer) | |
| Gelatin | 0.70 |
| Third Layer (Low Speed Red Sensitive Layer) | |
| Silver bromide which had been spectrally sensitized with red sensitizing dyes (ExS-1, 2, 3) (Average grain size 0.3 μm, Size distribution (variation coefficient) 8%, Octahedral) | 0.06 |
| Silver chlorobromide which had been spectrally sensitized with red sensitizing dyes (ExS-1, 2, 3) (5 mol % silver chloride, Average grain size 0.45 μm, Size distribution 10%, Octahedral) | 0.10 |
| Gelatin | 1.00 |
| Cyan coupler (ExC-1) | 0.11 |
| Cyan coupler (ExC-2) | 0.10 |
| Anti-color fading agent (equal amounts of Cpd-2, 3, 4, and 13) | 0.12 |
| Coupler dispersion medium (Cpd-5) | 0.03 |
| Coupler solvent (equal amounts of Solv-7, 2 and 3) | 0.06 |
| Fourth Layer (High Speed Red Sensitive Layer) | |
| Silver bromide which had been spectrally sensitized with red sensitizing dyes (ExS-1, 2, 3) (Average grain size 0.06 μm, Size distribution 15%, Octahedral) | 0.14 |
| Gelatin | 1.00 |
| Cyan coupler (ExC-1) | 0.15 |
| Cyan coupler (ExC-2) | 0.15 |
| Anti-color fading agent (equal amounts of Cpd-2, 3, 4 and 13) | 0.15 |
| Coupler dispersion medium (Cpd-5) | 0.03 |
| Coupler solvent (equal amounts of Solv-7, 2 and 3) | 0.10 |
| Fifth Layer (Intermediate Layer) | |
| Gelatin | 1.00 |
| Color mixing preventing agent (Cpd-7) | 0.08 |
| Color mixing prevent agent solvent (equal amounts of Cpd-4 and 5) | 0.16 |
| Polymer latex (Cpd-8) | 0.10 |
| Sixth Layer (Low Speed Green Sensitive Layer) | |
| Silver Bromide which had been spectrally sensitized with a green sensitizing dye (ExS-3) (Average grain size 0.25μ, Grain size distribution 8%, Octahedral) | 0.04 |
| Silver bromide which had been spectrally sensitized with green sensitizing dyes (ExS-4) (Average grain size 0.45 μm, Grain size distribution 11%, Octahedral) | 0.06 |
| Gelatin | 0.80 |
| Magenta coupler (equal amounts of ExM-1 and 2) | 0.11 |
| Anti-color fading agent (Cpd-9) | 0.10 |
| Anti-staining agent (equal amounts of Cpd-10 and 22 | 0.014 |
| Anti-staining agent (Cpd-23) | 0.001 |
| Anti-staining agent (Cpd-12) | 0.01 |
| Coupler dispersion medium (Cpd-5) | 0.05 |
| Coupler solvent (Equal amounts of Solv-4 and 6) | 0.15 |
| Seventh Layer (High Speed Green Sensitive Layer) | |
| Silver Bromide which had been spectrally sensitized with green sensitizing dyes (ExS-3, 4) (Average grain size 0.8 μm, Grain size distribution 16%, Octahedral) | 0.10 |
| Gelatin | 0.80 |
| Magenta coupler (ExM-1, 2) | 0.11 |
| Anti-color fading agent (Cpd-9) | 0.10 |
| Anti-staining agent (equal amounts of Cpd-10 and 22) | 0.013 |
| Coupler dispersion medium (Cpd-5) | 0.05 |
| Coupler solvent (Equal amounts of Solv-4 and 6) | 0.15 |
| Eighth Layer (Intermediate Layer) | |
| Same as the fifth layer | |
| Ninth Layer (Yellow Filter Layer) | |
| Yellow Colloidal Silver | 0.20 |

-continued

| | g/m² |
|---|---|
| Gelatin | 1.00 |
| Color mixing preventing agent (Cpd-7) | 0.06 |
| Color mixing preventing agent solvent (equal amounts of Solv-4 and 5) | 0.15 |
| Polymer latex (Cpd-8) | 0.10 |
| Tenth Layer (Intermediate Layer) | |
| Same as the fifth layer | |
| Eleventh Layer (Low Speed Blue Sensitive Layer) | |
| Silver bromide which had been spectrally sensitized with blue sensitizing dyes (ExS-5, 6) (Average grain size 0.45 μm, Grain size distribution 8%, Octahedral) | 0.07 |
| Silver bromide which had been spectrally sensitized with blue sensitizing dyes (ExS-5, 6) (Average grain size 0.60 μm, Grain size distribution 14%, Octahedral) | 0.10 |
| Gelatin | 0.50 |
| Yellow coupler (ExY-1) | 0.22 |
| Anti-staining agent (Cpd-11) | 0.001 |
| Anti-color fading agent (Cpd-6) | 0.10 |
| Coupler dispersion medium (Cpd-5) | 0.05 |
| Coupler solvent (Solv-2) | 0.05 |
| Twelfth layer (High Speed Blue Sensitive Layer) | |
| Silver bromide which had been spectrally sensitized with blue sensitizing dyes (ExS-5, 6) (Average grain size 1.2 μm, Grain size distribution 21%, Octahedral) | 0.25 |
| Gelatin | 1.00 |
| Yellow coupler (ExY-1) | 0.41 |
| Anti-staining agent (Cpd-11) | 0.002 |
| Anti-color fading agent (Cpd-6) | 0.10 |
| Coupler dispersion medium (Cpd-5) | 0.05 |
| Coupler solvent (Solv-2) | 0.10 |
| Thirteenth Layer (Ultraviolet Absorbing Layer) | |
| Gelatin | 1.50 |
| Ultraviolet absorber (equal amounts of Cpd-1, 3 and 13) | 1.00 |
| Color mixing preventing agent (equal amounts of Cpd-6 and 14) | |
| Dispersion medium (Cpd-5) | 0.05 |
| Ultraviolet absorber solvent (equal amounts of Solv-1 and 2) | 0.15 |
| Anti-irradiation dye (equal amounts of Cpd-15 and 16) | 0.02 |
| | 0.02 |
| Anti-irradiation dye (equal amounts of Cpd-17 and 18) | 0.02 |
| Fourteenth Layer (Protective Layer) | |
| Fine grain silver chlorobromide (Silver chloride 97 mol %, Average grain size 0.2 μm) | 0.05 |
| Acrylic modified poly(vinyl alcohol) copolymer (Degree of modification 17%, molecular weight 50,000) | 0.02 |
| Poly(methyl methacrylate) grains (average grain size 2.4 μm) and silicon oxide (average grain size 5 μm) in equal quantities | 0.05 |
| Gelatin | 1.50 |
| Gelatin hardening agent (H-1) | 0.17 |

-continued

| | g/m² |
|---|---|
| Fifteenth Layer (Backing Layer) | |
| Gelatin | 2.50 |
| Sixteenth Layer (Reverse Side Protecting Layer) | |
| Poly(methyl methacrylate) grains (average grain size 2.4 μm) and silicon oxide (average grain size 5 μm) in equal quantities | 0.05 |
| Gelatin | 2.00 |
| Gelatin Hardening Agent (H-1) | 0.11 |

Preparation of Emulsion EM-1

Aqueous solutions of potassium bromide and silver nitrate were added simultaneously over a period of 15 minutes at a temperature of 75° C. with vigorous stirring, to an aqueous gelatin solution. Octahedral silver bromide grains of average grain size 40 μm were obtained. Next, 3,4-dimethyl-1,3-thiazolin-2-thione, sodium thiosulfate and chlorauric acid (tetrahydrate) were added sequentially, in amounts of 0.3 g, 4 mg and 5 mg, per mol of silver respectively to the emulsion. Chemical sensitization was carried out by heating the above mixture to 75° C. for a period of 80 minutes. The obtained grains were then used as cores and grown under the same precipitation conditions as in the first precipitation, whereupon a core/shell silver bromide emulsion consisting of a monodispersion of octahedra of a final average grain size of 0.65 μm was obtained. The variation coefficient of the grain size was about 10%. Sodium thiosulfate and cholorauric acid (tetrahydrate) were added, in an mount of 1.0 mg and 1.5 mg per mol of silver respectively to this emulsion. The emulsion was then chemically sensitized by heating it to 60° C. for a period of 45 minutes, whereupon an internal latent image type silver halide emulsion was obtained. In each of the photosensitive layers, ExZK-1 was used in an amount of $10^{-3}$ wt % with respect to the weight of the silver halide coated as a nucleating agent and Cpd-2 was used in an amount of $10^{-3}$ wt % with respect to the weight of the silver halide coated as a nucleation accelerator. Moreover, "Alkanol XC" (Dupont Co.) and sodium alkylbenzenesulfonate were used as emulsification and dispersion promotors, and succinic acid esters and "Magefac F-120" (made by the Dainippon Ink Co.) were used as coating promotors in each layer. Cpd-19, 20, and 21 were used as stabilizers in each of the silver halide and colloidal silver containing layers. The obtained samples were numbered samples 2–14. The compounds used in the example are indicated below.

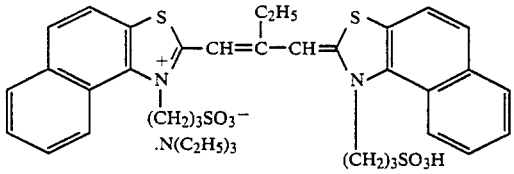

ExS-1

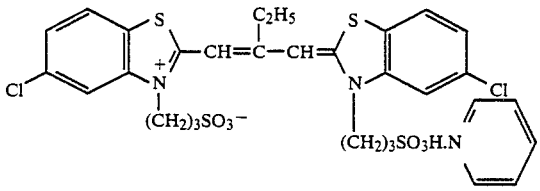

ExS-2

-continued
ExS-3
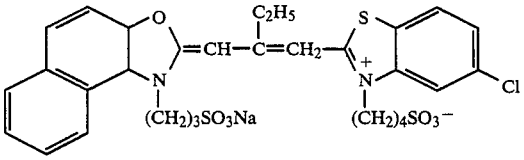
ExS-4
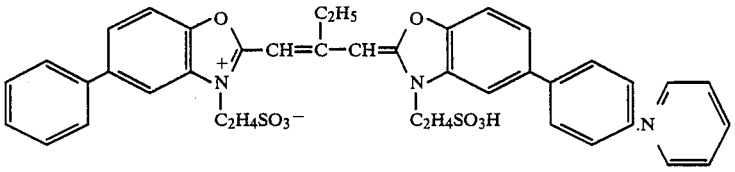
ExS-5
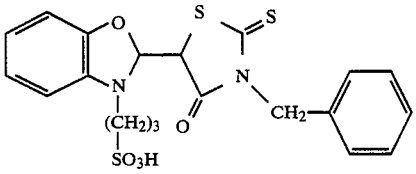
ExS-6
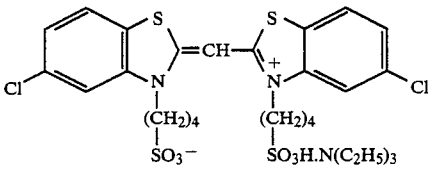
Cpd-1
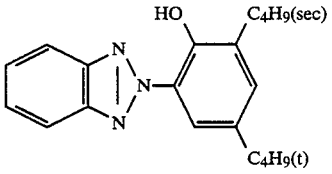
Cpd-2
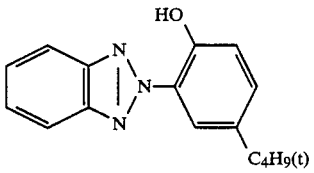
Cpd-3
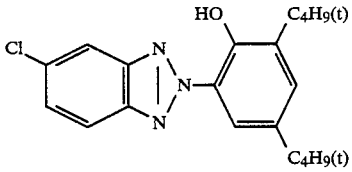
Cpd-4
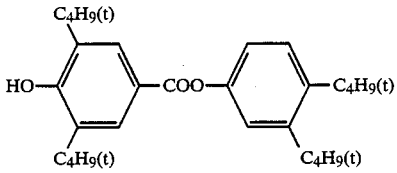
Cpd-5
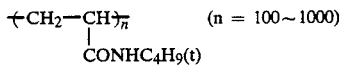

-continued
Cpd-6
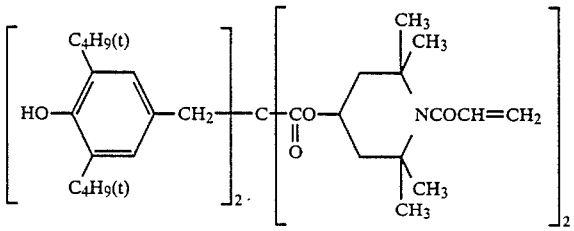
Cpd-7
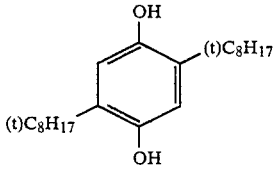
Poly(ethyl acrylate) Cpd-8
Cpd-9
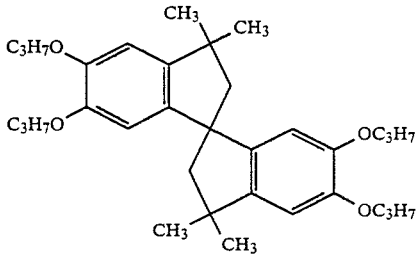
Cpd-10
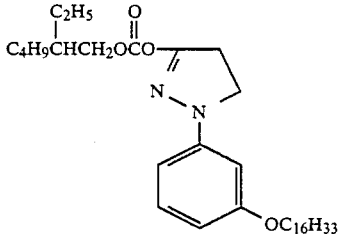
Cpd-11
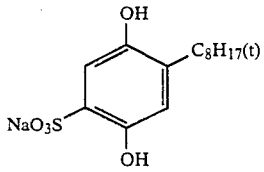
Cpd-12
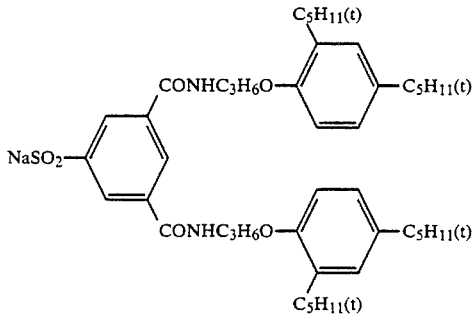
Cpd-13
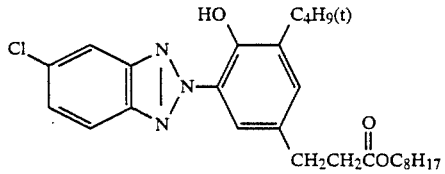

-continued
Cpd 14
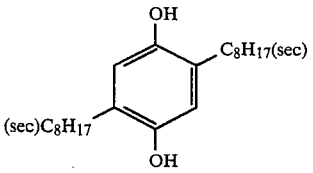
Cpd-15
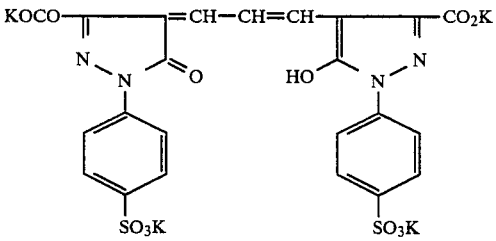
Cpd-16
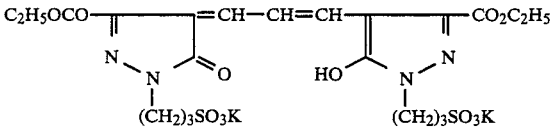
Cpd-17
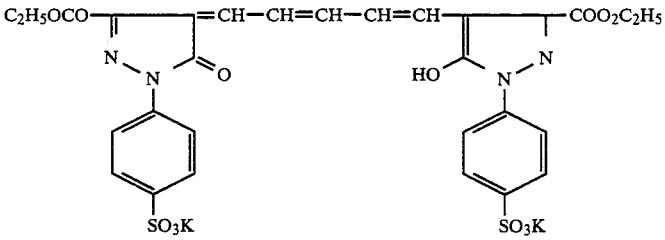
Cpd-18
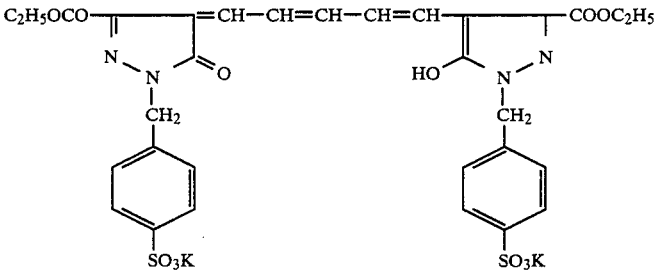
Cpd-19
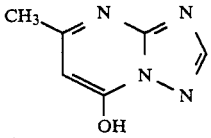
Cpd-20
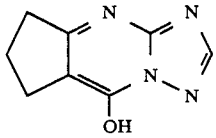
Cpd-21
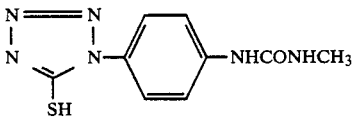

-continued
Cpd-22
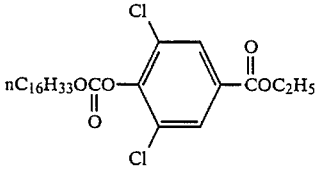
Cpd-23
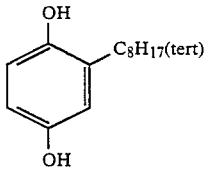
ExC-1
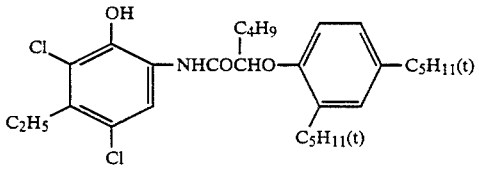
ExC-2
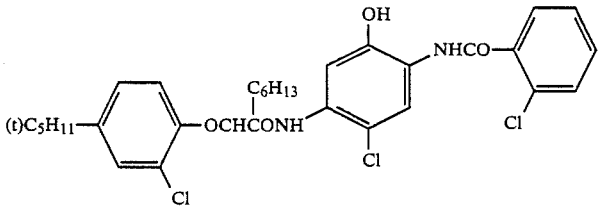
ExM-1
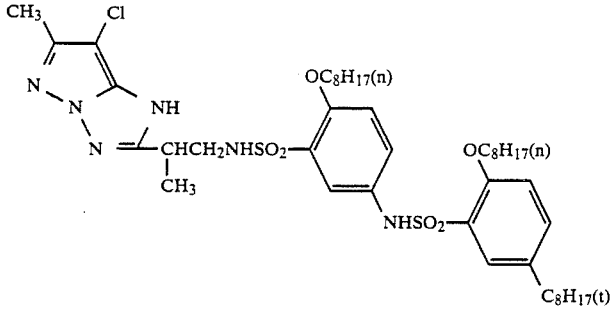
ExM-2
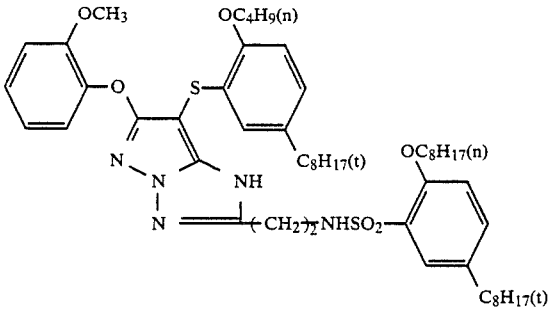

-continued

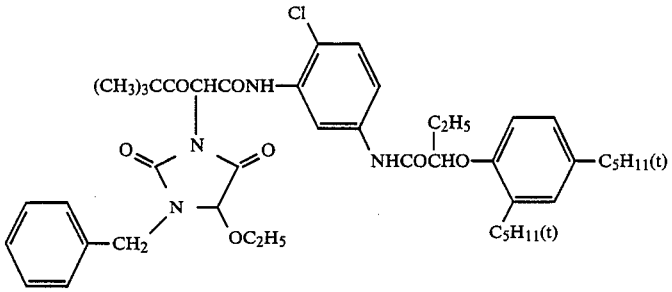

ExY-1

| | |
|---|---|
| Di(2-ethylhexyl)phthalate | Solv-1 |
| Trinonyl phosphate | Solv-2 |
| Di(3-methylexyl)phthalate | Solv-3 |
| Tricresyl phosphate | Solv-4 |
| Dibutyl phthalate | Solv-5 |
| Trioctyl phosphate | Solv-6 |
| Di(2-ethylhexyl)sebacate | Solv-7 |
| 1,2-Bis(vinylsulfonylacetamido)ethane | H-1 |
| 7-[3-(5-mercaptotetrazol-1-yl)benzamido]-10-propargyl-1,2,3,4-tetrahydroacridinium perchlorate | ExZK-1 |

The direct positive color photosensitive materials prepared by varying the type of nucleation accelerator as shown in Table 1, were subjected to a wedge exposure (1/10 second, 10 CMS) and then were subjected to processing operations A and D as indicated below (using a preprocessing run with replenishment to a total of 20 square meters of sample numbers 1 to 14). Next, the magenta colored image density was measured. $D_{max}$, $D_{min}$ and gradation values were shown in Table 1.

Processing operation D was the same as processing operation A except that 5.0 g of 3-methyl-4-amino-N-methyl-N-(β-methanesulfonamidoethyl)aniline sulfate was used as the main color developing agent in the color development bath.

Processing Operation A

| | Time | Temperature | Replenishment Rate |
|---|---|---|---|
| Color Development | 80 sec. | 38° C. | 260 ml/m$^2$ |
| Bleach-Fix | 30 sec. | 38° C. | 260 ml/m$^2$ |
| Water Wash (1) | 30 sec. | 38° C. | |
| Water Wash (2) | 30 sec. | 38° C. | 300 ml/m$^2$ |

At this time the replenishment factor for the water washing bath was 8.6 times.

Color Development Bath

| | Tank Solution | Replenisher |
|---|---|---|
| Diethylenetriaminepentaacetic acid | 0.5 g | 0.5 g |
| 1-Hydroxyethylidene-1-1, diphosphonic acid | 0.5 g | 0.5 g |
| Diethyleneglycol | 8.0 g | 10.7 g |
| Benzyl alcohol | 9.0 g | 12.0 g |

-continued

| | Tank Solution | Replenisher |
|---|---|---|
| Sodium bromide | 0.7 g | |
| Sodium chloride | 0.5 g | |
| Sodium sulfite | 2.0 g | 2.4 g |
| Hydroxylamine sulfate | 2.8 g | 3.5 g |
| 3-Methyl-4-amino-N-ethyl-N-(β-methanesulfonamidoethyl)aniline sulfate | 2.0 g | 2.5 g |
| 3-Methyl-4-amino-=N-ethyl-N-(β-hydroxyethyl)-aniline sulfate | 4.0 g | 4.5 g |
| Potassium carbonate | 30.0 g | 30.0 g |
| Fluorescent wihtener (stilbene based) | 1.0 g | 1.2 g |
| Pure water to make | 1,000 ml | 1,000 ml |
| pH | 10.50 | 10.90 |

The pH was adjusted using sodium hydroxide.

Bleach-Fix Bath

| | Tank Solution | Replenisher |
|---|---|---|
| Ammonium thiosulfate | 77 g | 100 g |
| Sodium disulfite | 14.0 g | 21.0 g |
| (Ethylenediaminetetraacetato)iron (III) ammonium salt dihydrate | 40.0 g | 53.0 g |
| Disodium ethylenediaminetetraacetate dihydrate | 4.0 g | 5.0 g |
| 2-Mercapto-1,3,4-triazole | 0.5 g | 0.5 g |
| Pure water to make | 1,000 ml | 1,000 ml |
| pH | 7.0 | 6.5 |

The pH was adjusted with aqueous ammonia or hydrochloric acid.

Wash Water

Pure water was used (for both tank solution and replenisher.

TABLE 1

| No. | Nucleation Accelerator* | Processing Operation A Dmax | Dmin | Gradation** | Processing Operating D Dmax | Dmin | Gradation** |
|---|---|---|---|---|---|---|---|
| 1 | A-2 | 2.3 | 0.12 | 2.2 | 2.1 | 0.12 | 1.8 |
| 2 | A-6 | 2.4 | 0.12 | 2.1 | 2.1 | 0.12 | 1.8 |
| 3 | A-8 | 2.4 | 0.13 | 2.3 | 2.1 | 0.12 | 1.7 |
| 4 | A-9 | 2.4 | 0.13 | 2.1 | 2.1 | 0.12 | 1.8 |
| 5 | A-10 | 2.3 | 0.13 | 2.0 | 2.0 | 0.12 | 1.8 |

TABLE 1-continued

| No. | Nucleation Accelerator* | Processing Operation A Dmax | Dmin | Gradation** | Processing Operating D Dmax | Dmin | Gradation** |
|---|---|---|---|---|---|---|---|
| 6 | A-12 | 2.3 | 0.14 | 2.1 | 2.0 | 0.12 | 1.8 |
| 7 | A-16 | 2.4 | 0.12 | 2.2 | 2.1 | 0.13 | 1.7 |
| 8 | A-20 | 2.3 | 0.13 | 2.2 | 2.0 | 0.12 | 1.8 |
| 9 | A-22 | 2.3 | 0.13 | 2.2 | 2.0 | 0.13 | 1.8 |
| 10 | A-26 | 2.3 | 0.13 | 2.2 | 2.0 | 0.13 | 1.8 |
| 11 | A-27 | 2.3 | 0.13 | 2.1 | 2.0 | 0.13 | 1.8 |
| 12 | A-30 | 2.3 | 0.14 | 2.1 | 2.0 | 0.14 | 1.8 |
| 13 | A-31 | 2.3 | 0.13 | 2.1 | 2.0 | 0.13 | 1.8 |
| 14 | — | 1.9 | 0.30 | 1.3 | 1.6 | 0.22 | 1.4 |

*Added in an amount of $4.2 \times 10^{-4}$ mol/mol of silver
**Gradation is taken as the average gradation between densities of 0.3 and 1.0

The Dmax values for sample numbers 1 to 13 containing a nucleation accelerator of the present invention, was higher than the value for sample number 14, a comparative example. Further, the Dmin values for samples Nos. 1–13 were lower and the gradation was harder than sample No. 14. Thus, these materials were preferred. The above effect was most pronounced utilizing processing operation A which included a developing agent of the present invention. Moreover, similar results were obtained with the yellow and cyan images.

EXAMPLE 2

Example 1 was repeated except that the materials were processed using processing operation B indicated below instead of processing operation A.

Processing Operation B

| | Time | Temperature | Replenishment Rate |
|---|---|---|---|
| Color Development | 80 sec. | 40° C. | 300 ml/m$^2$ |
| Bleach-Fix | 40 sec. | 38° C. | 300 ml/m$^2$ |
| Water Wash (1) | 30 sec. | 38° C. | |
| Water Wash (2) | 30 sec. | 38° C. | 300 ml/m$^2$ |

At this time the replenishment rate for the water washing bath was 8.6 times the amount of the liquid carried over from the previous bath.

Color Development Bath

| | Tank Solution | Replenisher |
|---|---|---|
| Diethylenetriaminepenta-acetic acid | 0.5 g | 0.5 g |
| Sodium sulfite | 2.0 g | 2.5 g |
| Sodium bromide | 0.6 g | |
| Hydroxylamine sulfate | 2.6 g | 3.3 g |
| 4-Amino-N-ethyl-N-(β-hydroxyethyl)aniline sulfate | 7.0 g | 9.3 g |
| Potassium carbonate | 30.0 g | 30.0 g |
| Fluorescent whitener, Whitex 4 (Sumitomo Chemical Inc.) | 1.0 g | 1.3 g |
| Pure water to make | 1,000 ml | 1,000 ml |
| pH | 10.50 | 10.90 |

The pH was adjusted using sodium hydroxide.

Bleach-Fix Bath

| | Tank Solution = Replenisher |
|---|---|
| Ammonium thiosulfate | 100 g |
| Sodium bisulfite | 21.0 g |
| (Ethylenediaminetetraacetato)-iron (III) ammonium salt dihydrate | 50.0 g |

-continued

| | Tank Solution = Replenisher |
|---|---|
| disodium ethylenediaminetetraacetato dihydrate | 5.0 g |
| Pure water to make | 1000 ml |
| pH | 6.5 |

The pH was adjusted with aqueous ammonia or hydrochloric acid.

Wash Water

Pure water was used (for both tank solution and replenisher)

Here the pure water was obtained by removing all cations other than hydrogen ions and all anions other than hydroxyl ions to a concentration not exceeding 1 ppm from town water using ion exchange resin.

EXAMPLE 3

Direct positive color photosensitive materials were prepared as discussed in example 1 except that the nucleating agent ExZK-1 was removed and the nucleation accelerators shown in table 2 were used.

These materials were exposed as shown in example 1. The materials were then processed using the processing operations C and E indicated below (replenishment running processing was carried out to a total of 20 square meters of sample numbers 1–5exposed such a way that the proportion of the developed silver was 50% of the coated silver). Processing operation E was the same as processing operation C except that 6.0 g of 3-methyl-4-amino-N-ethyl-N-(β-methanesulfonamidoethyl)aniline sulfate was per liter of the tank solution used as the developing agent.

The cyan colored image densities were measured and the results obtained are shown in table 2.

Processing Operation C

| | Time | Temperature | Replenishment Rate |
|---|---|---|---|
| Color Development*1 | 135 sec. | 36° C. | 320 ml/m$^2$ |
| Bleach-Fix | 40 sec. | 36° C. | 320 ml/m$^2$ |
| Stabilizer (1) | 40 sec. | 36° C. | |
| Stabilizer (2) | 40 sec. | 36° C. | 320 ml/m$^2$ |
| Drying | 40 sec. | 70° C. | |

*1The color development process was carried out while light fogging the material for 15 seconds with white light of an intensity of 1 lux, 15 seconds after immersing the material in the color development bath.

Color Development Bath

| | Tank Solution | Replenisher |
|---|---|---|
| Hydroxyethylaminodiacetic acid | 0.5 g | 0.5 g |
| β-Cyclodextrin | 1.5 g | 1.5 g |
| Monoethylene glycol | 9.0 g | 10.0 g |
| Benzyl alcohol | 9.0 g | 10.0 g |
| Monoethanolamine | 2.5 g | 2.5 g |
| Sodium bromide | 2.3 g | 1.5 g |
| Sodium chloride | 5.5 g | 4.0 g |
| N,N-diethylhydroxylamine | 5.9 g | 6.5 g |
| 3-Methyl-4-amino-N-ethyl-N-(β-methanesulfonamido)aniline sulfate | 4.5 g | 5.0 g |
| Potassium carbonate | 30.0 g | 35.0 g |
| Fluorescent whitener, Whitex 4 (Sumitomo Chemical Inc.) | 1.0 g | 1.2 g |
| Pure water to make | 1,000 ml | 1,000 ml |
| pH | 10.30 | 10.70 |

The pH was adjusted using sodium hydroxide.

Bleach-Fix Bath

| | Tank Solution = Replenisher |
|---|---|
| Ammonium thiosulfate | 110 g |
| Sodium bisulfite | 12 g |
| (Diethylenetriaminepentaacetato) iron (III) ammonium salt | 80 g |
| Diethylenetriaminepentaacetic acid | 5 g |
| 2-Mercapto-5-amino-1,3,4-thiadiazole | 0.3 g |
| Pure water to make | 1,000 ml |
| pH | 6.8 |

The pH was adjusted with aqueous ammonia or hydrochloric acid.

Stabilizer Bath

| | Tank Solution = Replenisher |
|---|---|
| 1-Hydroxyethylidene-1,1-diphosphonic acid | 2.7 g |
| o-Phenylphenol | 0.2 g |
| Potassium chloride | 2.5 g |
| Bismuth chloride | 1.0 g |
| Zinc chloride | 0.25 g |
| Sodium sulfite | 0.3 g |
| Ammonium sulfate | 4.5 g |
| Fluorescent whitener, Whitex 4 (Sumitomo Chemical Inc.) | 0.5 g |
| Pure water to make | 1,000 ml |
| pH | 7.2 |

The pH was adjusted with sodium hydroxide.

TABLE 2

| | Nucleation | Processing Operation C | | | Processing Operation E | | |
|---|---|---|---|---|---|---|---|
| No. | Accelerator* | Dmax | Dmin | Gradation** | Dmax | Dmin | Gradation** |
| 1 | A-6 | 2.3 | 0.12 | 2.1 | 2.0 | 0.13 | 1.7 |
| 2 | A-8 | 2.4 | 0.13 | 2.0 | 2.0 | 0.13 | 1.6 |
| 3 | A-15 | 2.3 | 0.12 | 2.1 | 1.9 | 0.13 | 1.6 |
| 4 | A-22 | 2.3 | 0.13 | 2.1 | 2.0 | 0.13 | 1.6 |
| 5 | — | 1.9 | 0.35 | 1.3 | 1.6 | 0.24 | 1.4 |

*Added in an amount of $1.5 \times 10^{-4}$ mol/mol silver
**Gradation the same as in Example 1

Sample numbers 1–4 containing a nucleation accelerator of the present invention had a higher Dmax value, a lower Dmin value and a harder gradation, than comparative example No. 5 and were thus preferred. The above effect was more pronounced when utilizing development process C which included a developing agent of the present invention.

Similar results were obtained in respect of the magenta and yellow colored image densities.

EXAMPLE 4

Example 3 was repeated except that emulsion EM-2 having a different grain size, was utilized in place of emulsion EM-1.

Emulsion EM-2

A mixed aqueous solution of potassium bromide and sodium chloride, and an aqueous silver nitrate solution were added simultaneously over a period of about 11 minutes at a temperature of 65° C. with vigorous stirring, to an aqueous gelatin solution to which 0.07 g per mol of silver of 3,4-dimethyl-1,3-thiazolin-2-thione had been added. A monodisperse silver chlorobromide emulsion of average grain size of 23 μm was obtained (silver bromide content 45 mol %). Next, 61 mg of sodium thiosulfate per mol of silver and 42 mg of chlorauric acid (tetrahydrate) per mol of silver were added to the emulsion. A chemical sensitization treatment was then carried out by heating the emulsion to 65° C. for a period of 60 minutes. The obtained silver chlorobromide grains were then used as cores and grown under the same precipitation conditions as in the first precipitation. Thus, a core/shell silver cholorobromide emulsion consisting of a monodispersion of the final average grain size of 0.65 μm was obtained (silver bromide content 45 mol %). Next, 1.5 mg of sodium thiosulfate and 1.5 mg of chlorauric acid (tetrahydrate) per mol of silver, were added to the emulsion. Chemical sensitization was then carried out by heating the emulsion to 60° C. for a period of 60 minutes. Thus, an internal latent image type silver halide emulsion (EM-2) was obtained.

EXAMPLE 5

Emulsion EM-3 was prepared in the same way as emulsion EM-1 except that $5.6 \times 10^{-5}$ mol per mol of silver, of lead nitrate was added to the emulsion during the formation of the cores. Emulsions of each grain size were prepared similarly to EM-3.

Similar results were obtained by repeating example 1 except that EM-3 and the similar emulsions of each grain size were used.

The direct positive images obtained by means of the method of image formation of the present invention have a high maximum image density and a low minimum image density, and hard gradation, and thus they are suitable for practical use.

While the invention has been described in detail and with reference to specific embodiments thereof, it will be apparent to one skilled in the art that various changes and modifications can be made therein without departing from the spirit and scope thereof.

What is claimed is:

1. A method for the formation of direct positive color images wherein, after image-wise exposure of a direct positive color photosensitive material which comprises at least one internal latent image type silver halide emulsion layer which has not been pre-fogged and color image forming couplers on a support, the material is subjected to development after and/or during a fogging process, the development process being carried out using a development bath which contains at least one N-hydroxyalkyl substituted p-phenylenediamine derivative in the presence of at least one compound of general formula and/or as indicated below:

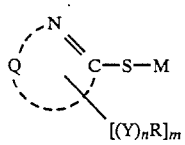

(I)

wherein

Q represents the group of atoms required to form a five- or six-membered heterocyclic ring, which heterocyclic ring may be condensed with a carbon aromatic ring or a heterocyclic aromatic ring, Y represents a divalent linking group consisting of at least one atom selected from the group consisting of carbon atom, nitrogen atom, oxygen atom, sulfur atom, and R represents an organic group which includes at least one thioether group, amino group, ammonium group, ether group or hetrocyclic group, n represents 0 or 1, m represents 0, 1 or 2, M represents a hydrogen atom, alkali metal atom, ammonium group or a group which is cleaved under alkaline conditions;

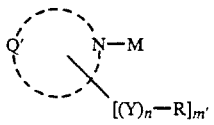

(II)

wherein

Q' represents the group of atoms required to form a five or six membered heterocyclic ring which can form imino silver, Y, R, n and M are the same as those in general formula, and m' represents 1 or 2.

2. A method for the formation of direct positive color images as in claim 1, wherein the fogging process is carried out using a light fogging method in which a second exposure is applied to the whole surface of the photosensitive layer or a chemical fogging method in which the development process is carried out in the presence of a nucleating agent.

3. A method for the formulation of direct positive color images as in claim 1, wherein the compound represented by general formula is selected from the compounds represented by general formulae (III , (IV), (V), and (VI):

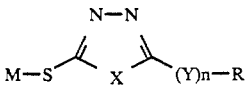

(III)

wherein M represents a hydrogen atom, alkali metal atom, ammonium group or a group which is cleaved under alkaline conditions, X represents an oxygen atom, sulfur atom or selenium atom, Y represents a divalent linking group consisting of at least one atom selected from the group consisting of carbon atom, nitrogen atom, oxygen atom, sulfur atom, and R represents an organic group which includes at least one thioether group, amino group, ammonium group, ether group or heterocyclic group, n represents 0 or 1;

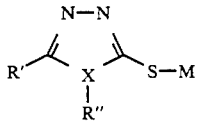

(IV)

wherein R' represents a hydrogen atom, halogen atom, nitro group, mercapto group, unsubstituted amino group, substituted or unsubstituted alkyl group, a substituted or unsubstituted alkenyl group, a substituted or unsubstituted aralkyl group, a substituted or unsubstituted aryl group, or a $-(Y)_n-R$ group, R'' represents a hydrogen atom, an unsubstituted amino group or a $-(Y)_n-R$ group, R' and R'' both represent $-(Y)_n-R$ groups, these groups may be the same or different, provided that at least one of R' and R'' represents a $-(Y)_n-R$ group, M, R, Y, and n each have the same meaning as in the aforementioned general formula (IV);

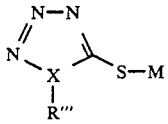

(V)

wherein R''' represents a $-(Y)_n-R$ group; and M, R, Y, and n each has the same meaning as in the aforementioned general formula (IV); and

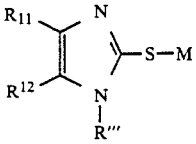

(VI)

wherein $R^{11}$ and $R^{12}$ represent hydrogen atoms, halogen atoms, substituted or unsubstituted amino groups, nitro groups, substituted or unsubstituted alkyl groups, alkenyl groups, aralkyl groups or aryl groups, and M and R''' each has the same meaning as in the aforementioned general formula (V).

4. A method for the formation of direct positive color images as in claim 1, wherein the heterocyclic ring is a pyridine ring, a pyrimidine ring, a triazine ring, a triazole ring or an imidazole ring.

5. A method of formation of direct positive color images as in claim 1, wherein the divalent linking group is selected from the group consisting of

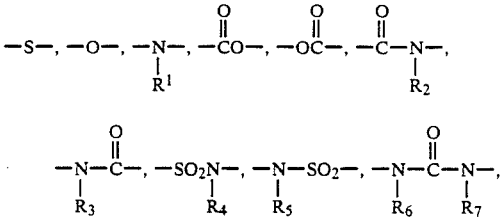

-continued

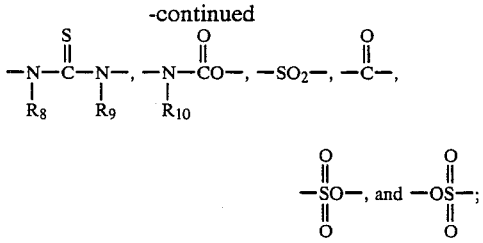

wherein $R_1$, $R_2$, $R_3$, $R_4$, $R_5$, $R_6$, $R_7$, $R_8$, $R_9$, $R_{10}$ each represents a hydrogen atom, a substituted or unsubstituted alkyl group, a substituted or unsubstituted aryl group, a substituted or unsubstituted alkenyl group, or a substituted or unsubstituted aralkyl group.

6. A method for the formation of direct color images as in claim 1, wherein the organic group is selected from the group consisting of a hydrochloride of a dimethylaminoethyl group, an aminoethyl group, a diethylaminoethyl group, a dibutylaminoethyl group, or a dimethylaminopropyl group, a dimethylaminoethylthioethyl group, a 4-dimethylaminophenyl group, a 4-dimethylaminobenzyl group, a methylthioethyl group, an ethylthiopropyl group, a 4-methylthio-3-cyanophenyl group, a methylthiomethyl group, a trimethylammonioethyl group, a methoxyethyl group, a methoxyethoxyethoxyethyl group, a methoxyethylthioethyl group, a 3,4-dimethoxyphenyl group, a 3-chloro-4-methoxyphenyl group, a morpholinoethyl group, a 1-imidazolylethyl group, a morpholinoethylthioethyl group, a pyrroridinoethyl group, a piperidinopropyl group, a 2-pyridylmethyl group, a 2-(1-imidazolyl)ethylthioethyl group, a pyrazolylethyl group, a triazolylethyl group, and a methoxyethoxyethoxyethoxycarbonylaminoethyl group.

* * * * *

UNITED STATES PATENT AND TRADEMARK OFFICE

CERTIFICATE OF CORRECTION

PATENT NO. : 4,966,833

DATED : October 30, 1990

INVENTOR(S) : Noriyuki Inoue

It is certified that error appears in the above-identified patent and that said Letters Patent is hereby corrected as shown below:

On the title page:
In the ABSTRACT, line 20, before the phrase "carbon atom," insert --hydrogen atom,--.

Column 2, line 66, before the phrase "carbon atom," insert --hydrogen atom,--.

Column 39:
Claim 1, line 27, before the phrase "carbon atom," insert --hydrogen atom,--.

Column 40:
Claim 3, line 2, before the phrase "carbon atom," insert --hydrogen atom,--

Signed and Sealed this

Third Day of November, 1992

*Attest:*

DOUGLAS B. COMER

*Attesting Officer*

*Acting Commissioner of Patents and Trademarks*